US006397429B1

(12) United States Patent
Legatt et al.

(10) Patent No.: US 6,397,429 B1
(45) Date of Patent: Jun. 4, 2002

(54) RIDING FLOOR SCRUBBER

(75) Inventors: Donald J. Legatt, St. Michael; Paul T. Mueller, Bloomington; Wolfgang C. Lehmann; Galen Swenson, both of Maple Grove; Patrick Enzler, Minneapolis, all of MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 0 days.

(21) Appl. No.: 09/607,247

(22) Filed: Jun. 30, 2000

(51) Int. Cl.[7] ..... A47L 11/38

(52) U.S. Cl. ..... 15/401; 15/320; 15/339; 15/340.1

(58) Field of Search ..... 15/320, 340.1, 15/401, 339; 180/12, 13, 211, 43, 214

(56) References Cited

U.S. PATENT DOCUMENTS 3,065,490 A * 11/1962 Arones
3,461,479 A * 8/1969 Tierney (List continued on next page.)

FOREIGN PATENT DOCUMENTS

| | | | |
|---|---|---|---|
| DE | 3816098 | | 5/1988 |
| EP | 0786229 | A2 * | 7/1997 |
| EP | 0786229 | A3 * | 5/1998 |
| WO | WO 7900755 | | 10/1979 |

OTHER PUBLICATIONS

Windsor Industries, Inc., Quick/Pivot Owner's Guide, Model QK32/QP32, Apr. 1, 1998, 78 pgs.
Advance Machine Company, Hydro–Retriever 5010B Parts List (Models 452100,452105), 12/89, 39 pgs.
12 color photographs of a 75 centimeter width Comac floor scrubber.

*Primary Examiner*—Robert J. Warden, Sr.
*Assistant Examiner*—Theresa T. Snider
(74) *Attorney, Agent, or Firm*—Alan Kamrath Rider, Bennett, Egan & Arundel, LLP

(57) ABSTRACT

A riding floor scrubber (10) is disclosed having a relatively narrow cleaning width for passing through relatively narrow passages such as conventional doorways. The riding floor scrubber (10) includes a recovery tank (16) that is vertically and laterally arranged and removably attached to the back of a clean solution tank (14). The clean solution tank (14) includes spaced parallel side portions (26, 28) and the recovery tank (16) extends between the rear ends of the side portions (26, 28). The recovery tank (16) is secured by first and second brackets (42) that extend into recesses (44) on the clean solution tank (14), with the bottom of the recovery tank (16) including a lip portion (46) resting on a metal plate (20) of a chassis (18), with a battery pack (52) being supported on the plate (20) between the side portions (26, 28) of the clean solution tank (14). The clean solution tank (14) includes a middle portion (29) and a lower portion (24) integrally extending forwardly of the middle portion (29), with the left side portion (26) extending to the same longitudinal extent as the lower portion (24). The clean solution tank (14) is molded into a complex shape to maximize capacity, with the bottom of the clean solution tank (14) being recessed to receive the chassis (18) of a tricycle type to define triangular-shaped volumes (88).

21 Claims, 9 Drawing Sheets

U.S. PATENT DOCUMENTS 3,879,789 A * 4/1975 Kasper ..... 15/320
4,006,506 A 2/1977 Burgoon
4,041,567 A 8/1977 Burgoon ..... 15/320
4,196,492 A 4/1980 Johnson et al. ..... 15/320
4,293,971 A 10/1981 Block
4,333,202 A 6/1982 Block ..... 15/320
4,339,841 A * 7/1982 Waldhauser et al.
4,369,540 A 1/1983 Burgoon et al. ..... 15/340.1
4,483,041 A 11/1984 Waldhauser et al.
4,586,208 A * 5/1986 Trevarthen
4,819,676 A 4/1989 Blehert et al. ..... 134/21
4,845,801 A 7/1989 Milly et al. ..... 15/340.1
4,945,602 A 8/1990 Kohl et al. ..... 15/320
4,986,378 A * 1/1991 Kasper
5,093,955 A 3/1992 Blehert et al. ..... 15/320
5,178,655 A 1/1993 Sassier ..... 55/341.2
5,224,236 A 7/1993 Sallquist ..... 15/340.1
5,331,713 A 7/1994 Tipton ..... 15/320
5,369,838 A 12/1994 Wood et al. ..... 15/320
5,377,382 A 1/1995 Bores et al.
5,383,251 A 1/1995 Whitaker et al. ..... 15/320
5,454,138 A 10/1995 Mondigo et al.
5,455,985 A 10/1995 Hamline et al.
5,465,456 A 11/1995 Fellhauer et al. ..... 15/320
5,473,792 A 12/1995 Kent et al. ..... 15/320
5,566,422 A 10/1996 Geyer ..... 15/320
5,623,743 A * 4/1997 Burgoon et al.
5,640,738 A 6/1997 Williams et al. ..... 15/320
5,655,254 A * 8/1997 Bores et al.
5,706,549 A 1/1998 Legatt et al. ..... 15/385
5,829,095 A 11/1998 Legatt et al. ..... 15/412
5,873,138 A * 2/1999 Geyer et al.
5,890,258 A 4/1999 Lee ..... 15/320
5,901,410 A * 5/1999 Windmeisser
6,088,873 A 7/2000 Pacchini et al.
6,212,731 B1 * 4/2001 Eckerlein et al. ..... 15/320

* cited by examiner

RIDING FLOOR SCRUBBER

BACKGROUND OF THE INVENTION

The present invention relates generally to equipment for the floor-care industry, particularly to automatic floor scrubbers, and specifically to automatic floor scrubbers including unique provisions for riding on the floor scrubber and having a narrow cleaning width that permits passing through doorways and other relatively narrow passages.

A common method of cleaning hard floors is with a scrubber/dryer. These machines consist of a clean solution tank with means to apply solution to the floor, an agitating means for cleaning the floor, a dirty solution tank, and a vacuum means to pick up the dirty solution from the floor after the agitation action. The tanks and other mechanisms are usually attached to some type of chassis, which also has provisions for the power source, wheels, and motivation requirements. Scrubber/dryers can be either walk-behind units or ride-on units. The power source for mostly all the walk-behind units comes from a battery pack, while the power for ride-on units comes from a battery pack on the smaller machines or an internal combustion engine on the larger machines.

Walk-behind scrubber/dryers predated the ride-on machines in the market. The ride-on machines were developed after customers who had large applications—e.g., warehouses, etc.—recognized the benefits of having floors cleaned with solution rather than just swept. The physical size of the application demanded the added productivity of a ride-on unit. So, whereas the early walk-behind machines were of a narrower width—approximately 17" to 20"—and then wider width machines were developed—approximately 26" and 32" —the early ride-on machines were wide width machines, in the 50" to 60" range.

With the aging of the workforce, with many applications making aisle widths narrower to accommodate more usable space, and with increasing labor rates, there has, in the past five years or so, been a recognized need for ride-on machines of a narrower width. End-users who previously used walk-behind machines are now demanding the added productivity and efficiency of a ride-on unit, but in a package size that fits these smaller applications.

A number of ride-on machines have been developed to satisfy these needs. Certain of these machines include substantial metal chassis with front, rear and side channels to protect the tanks from damage in extreme environments, as many of the applications were more the likes of warehouses and factories rather than stores and supermarkets. However, a need has continued for a smaller ride-on machine, which can maximize its maneuverability for smaller, tighter applications. At the same time, it is important that the smaller ride-on machines have large tanks to be able to carry large amounts of solution, to avoid frequent stoppages for dumping and refilling.

The ride-on floor scrubber of the present invention overcomes difficulties described above and affords other features and advantages heretofore not available.

SUMMARY OF THE INVENTION

The riding floor scrubber of the present invention has, in its preferred embodiment, a relatively narrow 28" cleaning width. While minimizing the size of the ride-on floor scrubber, the volume of the clean solution tank is also maximized by forming the tank into a U-shape in the back under the seat, to continue to run one of the legs—preferably on the left side—to the front for the fall length of the machine, and horizontally under the feet of the operator.

Further, the chassis is of the tricycle type with only a single front wheel so that the front of the chassis can be made V-shaped. This allows the solution tank to extend in first and second V-shaped areas on the opposite sides of the chassis for the full thickness of the chassis. This results in a substantial increase in the tank volume.

It is therefore an object of this invention to provide a riding floor scrubbing machine having common functionalities and operational mechanisms, but which is small enough and maneuverable enough to pass through narrower passageways, such as grocery store aisles and conventional doorways. It is a further object of this invention to provide a riding floor scrubbing machine that is sturdy, having a strong, metal chassis, and that provides sufficient protection to fluid storage tanks, even in extreme environments.

It is also an object of the present invention to provide a smaller ride-on machine having large tanks to be able to carry large amounts of solution, thus avoiding frequent stoppages for dumping and refilling.

It is a further object of the present invention to position the batteries that power the ride-on floor cleaner so that they are accessible for maintenance purposes and replacement, and that the batteries are positioned relative to the wheels and the center of gravity of the machine to provide a stable operating condition, and consistent weights on each wheel.

It is yet a further object of the present invention to position the recovery tank so that contaminants may be thoroughly cleaned and flushed out of the tank to prevent bacteria and odors from developing. Thus, the recovery tank is intended to be as accessible and easy to clean as possible.

Other objects and advantages of the invention will become apparent from the following detailed description of an illustrative embodiment of this invention is described in connection with the drawings.

BRIEF DESCRIPTION OF THE DRAWINGS

The illustrative embodiment may best be described by reference to the accompanying drawings where.

Figure 1:
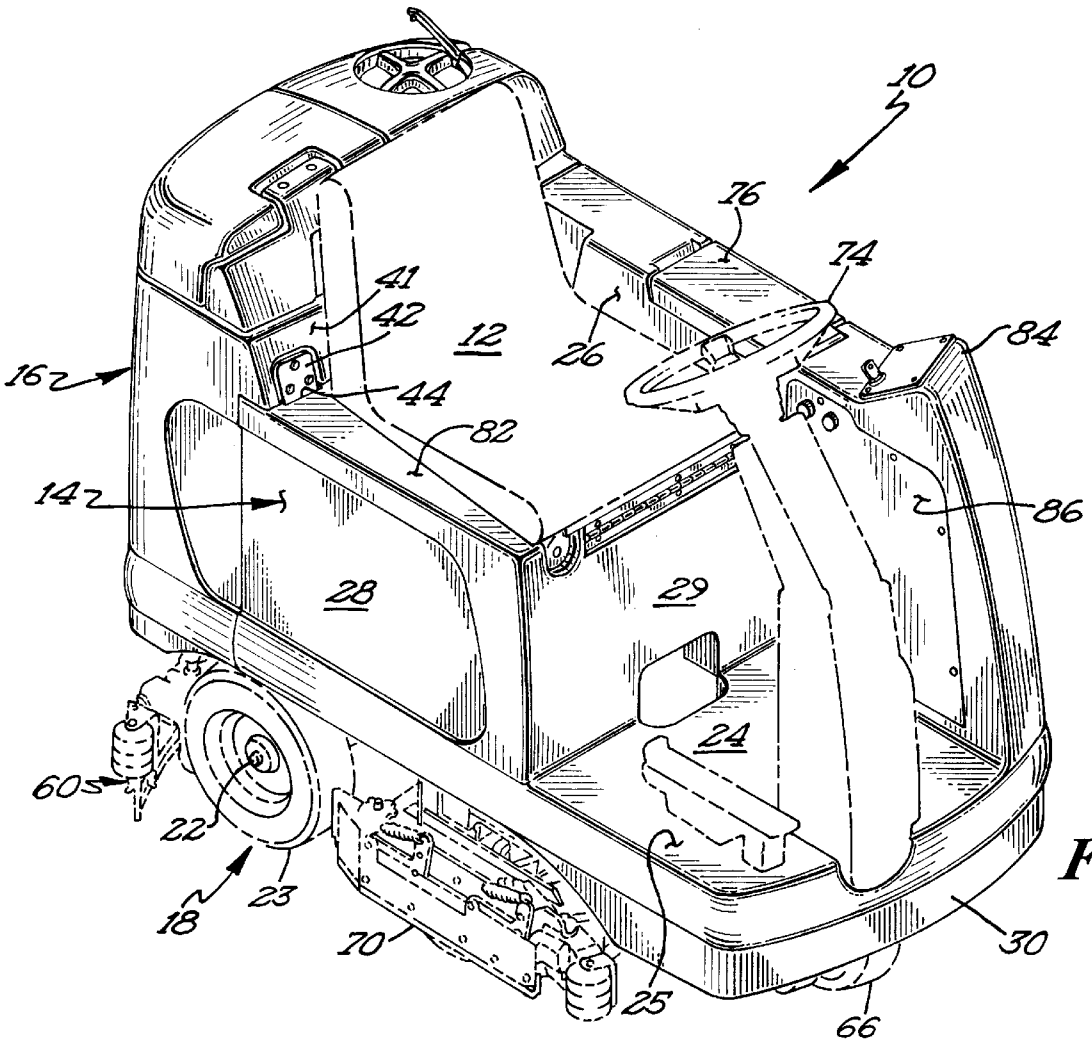
FIG. 1 is a perspective view of a riding floor scrubber according to the preferred teachings of the present invention.

All figures are drawn for ease of explanation of the basic teachings of the present invention only; the extensions of the figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top," "bottom," "right," "left," "forward," "rear," "first," "second," "inside," "outside," and similar terms are used herein, it should be understood that these terms have reference only to the structure shown in the drawings as it would appear to a person viewing the drawings and are utilized only to facilitate describing the illustrative embodiment.

DETAILED DESCRIPTION OF PREFERRED EMBODIMENTS

A floor surface cleaning machine according to the preferred teachings of the present invention is shown in the drawings in the preferred form of a floor scrubber and generally designated 10. In the most preferred form, scrubber 10 is of the ride-on type. Generally, scrubber 10 includes a seat 12 for a machine operator, a clean solution tank 14, a recovery tank 16, and a chassis 18 moveably supported on the floor surface.

Chassis 18 generally includes a rectangular chassis plate 20 spaced from and generally parallel to the floor surface and adapted to receive a battery pack 52 which can be made up of various batteries connected together to provide the appropriate power requirements and typically provided within a battery tray. Each of the batteries in the battery pack 52 can weigh up to 125 pounds. Chassis plate 20 is supported by a frame including right and left vertical side rails 32 and 34 extending generally parallel to each other and attached to the upper surface of plate 20. A lateral, vertical rail 54 extends generally perpendicularly between the front ends of rails 32 and 34 and across the upper surface of plate 20. A lateral, vertical plate 56 extends generally perpendicularly between the back ends of rails 32 and 34, beneath plate 20, and forward of the back or rear edge of plate 20. Right and left triangular shaped axle mounts 58 extend between plate 56 and rails 32 and 34 and mount a laterally extending rear axle 22 for rotatably mounting wheels 23 on the opposite ends thereof. Plate 20 includes mounting flanges 48 extending laterally outwardly from the lower edges of rails 32 and 34 adjacent the rear ends thereof.

In the most preferred form, scrubber 10 includes a solution pickup assembly shown as a squeegee assembly 60 mounted to chassis 18 for purposes of wiping the floor surface and collecting the dirty solution for vacuum pickup. Squeegee assembly 60 can be of any conventional design including a curved design as shown or a straight design and is oriented perpendicular to the forward movement and viewing direction. Generally, squeegee assembly 60 includes front and rear flexible blades 170 mounted to a support 172 so that blades 170 are spaced at the center and taper towards each other so that the ends are tight against each other. The front blade 170 has notches or slots cut in the free edge along its length to allow solution to pass therethrough. Blades 170 contact the floor surface and are forced into a flexed over position against the floor surface. A tube 174 is provided in support 172 in fluid communication between blades 170 adjacent the centers thereof and to which a vacuum can be supplied such that air and solution are pulled in through the slots in the front blade 170 and flow out of tube 174, with the rear blade 170 acting as a wiper to leave the floor surface dry.

Suitable provisions 176 are provided for floating squeegee assembly 60 on the floor surface during an operation mode as well as for raising squeegee assembly 60 from the floor surface during a transport or storage mode. In the most preferred form, provisions 176 include a mount 178 which could be made integral with or suitably removably secured to support 172 of squeegee assembly 60 as shown. First and second, upper, linkage arms 180 have first ends pivotably mounted to ears formed on or secured to vertical plate 56 at spaced, axially aligned locations equidistant from the centerline of chassis 18. The second ends of linkage arms 180 are pivotably mounted to ears formed on or secured to squeegee assembly 60 through mount 178 at spaced, axially aligned locations equidistant from the centerline of chassis 18 and parallel to the first ends, with the spacing between the first ends and between the second ends of arms 180 being equal. A third, lower, linkage arm 182 has its first end pivotably mounted to an ear formed on or secured to vertical plate 56 at a location on the centerline of chassis 18 and spaced from, parallel to and intermediate the first ends of arms 180. The second end of linkage arm 182 is pivotably mounted to an ear formed on or secured to squeegee assembly 60 through mount 178 at a location on the centerline of chassis 18 and spaced from, parallel to and intermediate the second ends of arms 180. The spacing of the second end of linkage arm 182 from the second ends of linkage arms 180 is in the same direction and spacing as the first end of linkage arm 182 from the first ends of linkage arms 180. The first and second ends of arms 180 and 182 are pivotably mounted in a manner so that arms 180 and 182 may have movement relative to the mounting ears in more than one plane and specifically in planes parallel to and perpendicular to the ends of linkage arms 180 and 182 received in the ears such as by the use of spherical rod end connectors as shown. Thus, it can be seen that mount 178 and squeegee assembly 60 secured thereto are restrained to chassis 18 through three linkage arms 180 and 182 and may move both vertically and horizontally. In the most preferred form, the length between the first and second ends of linkage arms 180 are fixed during manufacture and are not intended to be adjusted in the field. However, the length between the first and second ends of linkage arm 182 is adjustable in the field. Linkage arm 182 is shown being in the preferred form of a turnbuckle and includes a rotating knob 184, with the rotation of knob 184 in one direction causing threaded ends to thread inside a center section to thereby decrease the length between the ends and to thread out of the center section to thereby increase the length between the ends when rotated in the opposite direction. In the most preferred form, a wing nut is provided on one of the threaded ends for locking the length of linkage arm 182 after adjustment. It should be appreciated that linkage arms 180 and 182 are arranged to create a parallelogram-type linkage so that mount 178 and support 172 generally maintain the same or constant angle relative to plate 56 independent of the vertical or horizontal movement of mount 178 and support 172 relative to plate 56. However, by rotation of knob 184, the length of linkage arm 182 between its first and second ends can be varied to thereby vary the constant angle of mount 178 and support 172 relative to plate 56, with that angle being generally maintained independent of the vertical or horizontal movement of mount 178 and support 172 relative to plate 56.

Provisions 176 further include a bracket 186 attached to plate 56 in a spaced, parallel relation by a pair of longitudinally extending ears 188. Bracket 186 provides positive stops for limiting movement of linkage arms 180 and thus of squeegee assembly 60 in a vertical upward direction and in a horizontal side-to-side direction. Specifically, in the preferred form, bracket 186 is T-shaped and is positioned intermediate the first and second ends of linkage arms 180 with its leg being centered between the first ends of linkage arms 180 and having a width which is less than the spacing between the first ends of linkage arms 180, with the right and left edges of the leg of bracket 186 located intermediate linkage arms 180 and being equidistant from the centerline of chassis 18 and extending generally perpendicular to the floor surface. Similarly, the head of bracket 186 is positioned above linkage arms 180. In particular, squeegee assembly 60 can be raised from the floor surface until linkage arms 180 engage with the lower edge of the head of bracket 186 extending generally parallel to the floor surface and thereby acting as the upper extent that linkage arms 180 and squeegee assembly 60 can pivot vertically relative to plate 56. Additionally, the squeegee assembly 60 can be moved horizontally from the center of plate 56 to the left until the right linkage arm 180 engages the right edge of the leg of bracket 186 and thereby acting as the maximum extent that linkage arms 180 and squeegee assembly 60 can pivot horizontally to the left relative to plate 56. Similarly, squeegee assembly 60 can be moved horizontally from the center of plate 56 to the right until the left linkage arm 180 engages the left edge of the leg of bracket 186 and thereby acting as the maximum extent that linkage arms 180 and squeegee assembly 60 can pivot horizontally to the right relative to plate 56. It can then be appreciated that the extent that squeegee assembly 60 can be moved horizontally to the right or to the left or in other words, side-to-side depends upon the difference between the width of the leg of bracket 186 and the spacing between linkage arms 180.

Provisions 176 according to the preferred teachings of the present invention further include first and second extension springs 190 mounted in a diagonal fashion between plate 56 and squeegee assembly 60 through mount 178. In particular, springs 190 have first ends pivotably mounted to ears formed on or secured to vertical plate 56 at spaced, laterally aligned locations equidistant from the centerline of chassis 18 and at a vertical height above the floor surface. The second ends of springs 190 are pivotably mounted to ears formed on or secured to mount 178 for squeegee assembly 60 at spaced, laterally aligned locations equidistant from the centerline of chassis 18 and at a vertical height above the floor surface. The vertical height of the second ends of springs 190 from the floor surface is greater than the vertical height of the first ends of springs 190 such that the springs 190 extend downwardly from mount 178 to plate 56. Thus, springs 190 bias squeegee assembly 60 to move toward the floor surface with a desired force. Furthermore, in the most preferred form, the spacing between the first ends is different than between the second ends of springs 190 so that springs 190 extend diagonally between plate 56 and mount 178. Specifically, in the preferred form shown, the first ends of springs 190 are mounted to plate 56 at a spacing which is less than the spacing that the second ends of springs 190 are mounted to mount 178. It should be appreciated that when squeegee assembly 60 is in a center position relative to chassis 18, the pressure exerted by one spring 190 equally offsets the pressure exerted by the other spring 190. However, when squeegee assembly 60 is moved to one side or the other, one spring 190 will stretch and create more pressure and the other will relax and create less pressure. Thus, squeegee assembly 60 is biased by springs 190 to move toward the center location. It can be appreciated that springs 190 mounted according to the teachings of the present invention perform two functions, namely providing down pressure to mount 178 and thus squeegee assembly 60 and providing a centering bias to keep mount 178 and thus squeegee assembly 60 in the center of floor scrubber 10. It should also be appreciated that squeegee assembly 60 can be positioned such that the ends thereof extend different distances beyond the lateral extent of floor scrubber 10 such as by having squeegee assembly 60 positioned offset from mount 178, by having the center of provisions 176 being offset, or the like.

Provisions 176 according to the preferred teachings of the present invention further include a suitable mechanism for vertically moving squeegee assembly 60 relating to chassis 18. In the preferred form shown, a cable 192 has a free end secured to mount 178 and extends over a pulley 194 rotatably mounted between the free ends of ears 188. Cable 192 can be moved such as by having its opposite end attached to an electrically driven linear actuator which can be operated by movement of an electrical switch by the operator seated on seat 12.

It should be appreciated that squeegee assembly 60 must be oriented properly to optimize drying performance, must be subjected to down pressure sufficient to force blades 170 into a flexed over position in relation to the floor surface, must be able to be raised off the floor surface for transport and storage, and must be able to swing or move side-to-side in order to move out of the path of objects but generally stay centered in the rear of floor scrubber 10. Provisions 176 according to the preferred teachings of the present invention provide a durable manner to meet each of these functions and which is cost effective to manufacture, assemble, and maintain. Specifically, provisions 176 allow both vertical and horizontal movement, with the horizontal movement being generally in a lateral manner and in particular not along a significant arc. Further, provisions 176 and in particular linkage arm 182 provides the ability to tilt squeegee assembly 60 in an axis perpendicular to the movement and viewing direction, with the tilt or angle of squeegee assembly 60 being critical for optimum operation of squeegee assembly 60. Also, linkage arm 182 is a component of the linkage system which mounts squeegee assembly 60, and thus additional components and the costs and complexity associated therewith of prior squeegee tilting mechanisms are avoided. Further, linkage arms 180 and 182 for attaching squeegee assembly 60 to chassis 18 according to the teachings of the present invention are of a simple design including few components that can be easily fabricated, assembled and maintained to be cost effective so that the manufacturer is able to offer floor scrubber 10 to the customer for an attractive price, but are versatile enough to allow for the proper functionality of squeegee assembly 60. Additionally, springs 190 according to the preferred teachings of the present invention provides the necessary down pressure on squeegee assembly 60 without the use of weights as in prior floor scrubbers and also provides for centering squeegee assembly 60 relative to chassis 18 which is not provided in some prior floor scrubbers or is performed by separate mechanisms in other prior floor scrubbers, which separate components adding cost and complexity to such prior floor scrubbers.

Chassis 18 in the most preferred form is of the tricycle type and generally includes right and left vertical rail portions 36 and 38 extending at an acute angle inwardly from the forward ends of rails 32 and 34, respectively. The front ends of rail portions 36 and 38 terminate in a front rail portion 62 extending generally parallel to lateral rail 54. Plate 20 includes an extension 64 generally extending below portions 36, 38 and 62, and includes mounting flanges 50 extending laterally beyond portions 36 and 38 adjacent portion 62.

In the most preferred form, scrubber 10 includes a single, steerable drive wheel 66 mounted to chassis 18 such as by suitable provisions 68 provided in extension 64 adjacent to rail portion 62. In the most preferred form, wheel 66 is a purchased component of conventional design and includes a battery powered motor for purposes of driving scrubber 10. Further, scrubber 10 includes a suitable scrubbing member 70 mounted to chassis 18 for purposes of agitating the floor surface. Scrubbing member 70 can be of any conventional design and includes suitable provisions for floating on the floor surface during an operation mode as well as being raised from the floor surface during a transport mode.

Chassis 18 in the most preferred form includes a steering assembly mount 72 extending forwardly from the front rail portion 62 and in the most preferred form is offset laterally to the right from the center line defined by provisions 68 for mounting drive wheel 66. A suitable steering assembly 74 is mounted to assembly mount 72 for purposes for rotating drive wheel 66 in provisions 68 and thereby steering drive wheel 66. Steering assembly 74 can be of any conventional design and can have the ability to tilt away from seat 12 for ease of operator entry and exit.

According to the preferred teachings of the present invention, clean solution tank 14 is integrally formed of plastic by roto-molding and generally includes first and second, vertical, longitudinally extending side portions 26 and 28 in a spaced parallel relation extending on opposite sides of chassis plate 20 and having rear ends adjacent to the rear edge of the chassis plate 20. In the most preferred form, side portion 28 (located on the right side of scrubber 10 when the operator is on seat 12) includes an expansion extending longitudinally beyond rail 32 such that side portion 26 has a longitudinal length generally corresponding to rail 32 whereas side portion 26 (located on the left side of scrubber 10 when the operator is on the seat 12) has a longitudinal length generally corresponding to chassis 18. Tank 14 further includes a laterally extending, vertical middle portion 29 extending generally perpendicularly between the forward end of side portion 28 and side portion 26 spaced from the rear ends and particularly intermediate its forward and rear ends of side portion 26. In the most preferred form, portion 29 generally corresponds to and overlays rail 54 and in the most preferred form includes a cut-out portion for receipt of and access to the drive motor and other components of scrubbing member 70. In the most preferred form, the upper surfaces of portions 28 and 29 have an equal height. In the most preferred form, side portion 26 has a vertical height slightly greater than the height of side portion 28 and includes provisions 76 for adding solution to tank 14, which is shown as including a hinged cover. Side portion 26 includes an inwardly facing recess 78 adjacent the rear end and extending from the upper surface thereof defining a shoulder at a height generally corresponding to the height of side portion 28. The upper, rear corner of side portion 26 is stepped and includes a horizontal upper surface or ledge 80 at a height generally corresponding to the height of the upper surface of side portion 28.

In the most preferred form, seat 12 is mounted to a plate 82 having a front edge extending between its right and left sides and which is pivotably supported and hingedly mounted to the upper surface of middle portion 29. In its normal position, the right side of plate 82 abuts with the upper surface of side portion 28. An ear 83 integrally extends from the left side of plate 82 in a direction opposite to the right side of plate 82 and spaced from the front edge of plate 82. Recess 78 and particularly the shoulder defined thereby has a longitudinal length generally equal to and for receipt of the longitudinal length of ear 83 when plate 82 is pivoted about its front edge hinged to middle portion 29, with the longitudinal lengths of recess 78 and ear 83 being considerably shorter than the left side of plate 82. When the right side of plate 82 is supported on the upper surface of side portion 28, ear 83 extends into and is supported upon the shoulder of recess 78, with plate 82 spanning side portions 26 and 28. Plate 82 and seat 12 can be pivoted relative to middle portion 29 until seat 12 engages with steering assembly 74.

It should be appreciated that the provision of ear 83 according to the most preferred form of the present invention is advantageous in allowing the vertical height of left side portion 26 to be greater than the vertical height of right side portion 28 while maximizing the volume of side portion 26 and minimizing the size of tank 14 and thus of floor scrubber 10. In particular, with tank 14 including portions 26 and 28 in a spaced relation on opposite sides of chassis plate 20 and in the most preferred form for receiving batteries 52 therebetween and specifically without tank 14 extending beneath seat 12 for being supported thereby, it is necessary to support plate 82 to span between portions 26 and 28 and thus be supported by its side edges. This is not a problem for the right side portion 28 where support plate 82 can rest directly upon the top surface thereof. However, supporting the left side edge of support plate 82 on top of left side portion 26 would prevent left side portion 26 from having a greater vertical height to accommodate provisions 76 and angled portion 84 and recesses 86 and 130 which will be described in more detail hereinafter, and the like. Similarly, to utilize a ledge extending along the entire length of the left side edge of support plate 82 would require that the size of side portion 26 be increased by the width of the ledge and/or the width of the increased vertical height portion be decreased, both undesirable consequences. By utilizing ear 83 being supported on a shoulder of recess 78 of the most preferred form of floor scrubber 10 of the present invention, the width of the increased vertical height can be maximized aside from the longitudinal length of recess 78 and ear 83 which is considerably shorter than the side edge of plate 82 and the physical size of floor scrubber 10 can be minimized.

According to the preferred teachings of the present invention, clean solution tank 14 further includes a horizontal, lower portion 24 extending spaced from and generally parallel to the floor surface. Lower portion 24 integrally extends longitudinally forward from the lower end of middle portion 29 to a longitudinal extent generally equal to side portion 26. Lower portion 24 also integrally extends from the lower end of side portion 26 and has an outer lateral extent generally equal to the outer lateral extent of side portion 28. Clean solution tank 14 further includes a depending skirt portion 30 of a generally U-shape having a central member extending along the front of portion 24 and having first and second leg members extending along the outer edges of portion 24 (and portion 26) at a longitudinal extent towards but not to the extent of lateral rail 54.

In the most preferred form, the upper front corner of portion 26 includes angled portion 84 that includes recess 130 integrally formed with tank 14 and extending into the hollow interior of tank 14. In particular, recess 130 includes first and second, vertical side plates or walls 132 integrally extending from the upper edges of and closely adjacent the inner surfaces of the inside and outside walls of side portion 26 which define the hollow interior of tank 14 and generally parallel to the forward movement and viewing direction. Recess 130 further includes front and back plates or walls 134 integrally extending from the top wall of side portion 26, integrally extending between side walls 132 and arranged generally perpendicular to the forward movement and viewing direction. Recess 130 further includes a bottom plate or wall 136 integrally extending from and between the lower ends of walls 132 and 134. Recess 130 includes an open top or face defined by the upper ends of walls 132 and 134 and extending generally coplanar with the top wall of side portion 26 in the angled portion 84. A panel 138 is removably secured to tank 14 for closing the open face of recess 130. In the most preferred form, panel 138 is generally planar and extends generally coplanar with the top wall of side portion 26 in the angled portion 84. Electrical components in the form of suitable gauges or displays of machine functions including but not limited to battery charge level, ground speed, scrubbing member 70 function readouts, and the like as well as on/off switch 140 associated with operating floor scrubber 10 for treating the floor surface in the preferred form mounted to panel 138 are received in recess 130 and enclosed in recess 130 by panel 138. It should be noted that angled portion 84 positions panel 138 in a non-horizontal manner and in particular in the preferred form with the forward edge being elevated above the back edge so that the displays of panel 138 can be viewed by the operator while sitting in seat 12.

The inside wall of side portion 26 in front of middle portion 29 includes recess 86 integrally formed with tank 14 and extending into the hollow interior of tank 14 and spaced from recess 130. In particular, recess 86 includes front and back vertical partitions or walls 142 integrally extending from the inside wall of side portion 26 spaced from the front wall of side portion 26 and middle portion 29. Recess 86 further includes a top horizontal partition or wall 144 and a bottom horizontal partition or wall 146 integrally extending from the inside wall of side portion 26 and integrally extending between walls 142. Recess 86 further includes an inner vertical side partition or wall 148 integrally extending from and between the inner ends of walls 142, 144 and 146, spaced from the outside wall of side portion 26 and arranged generally parallel to the forward movement and viewing direction. Recess 86 includes an open side or face defined by the outer ends of walls 142, 144 and 146 and which is generally vertically arranged and located in the forward movement and viewing direction in front of seat 12 and parallel to the forward movement and viewing direction. A panel 150 is removably secured to tank 14 for closing the open face of recess 86 and extends generally coplanar with the inside wall of side portion 26 of tank 14 in the preferred form.

In the preferred form, an electrical assembly 152 is held inside of recess 86 and in the most preferred form is mounted to inner side wall 148. Electrical assembly 152 includes operational electrical components associated with operating floor scrubber 10 for treating the floor surface including but not limited to the traction speed controller, main electronic circuit boards, relays and electronic controls of scrubber 10. In the most preferred form, panel 150 includes louvers 162 for allowing air passage into recess 86 for cooling electrical assembly 152. Panel 150 further includes apertures allowing passage of control knobs of electrical assembly 152 to pass therethrough for access by the operator outside of panel 150 and recess 86.

According to the preferred teachings of the present invention, a passage 154 is integrally formed and extends between bottom wall 136 of recess 130 and top wall 144 of recess 86 for routing of an electrical harness 156 through the hollow interior of tank 14 between the electrical components inside recess 130 and electrical assembly 152 inside recess 86. Similarly, a passage 158 is integrally formed and extends between bottom wall 146 of recess 86 and the bottom wall defining the hollow interior of tank 14 and arranged generally parallel to the floor surface for routing of an electrical harness 160 through and outside of the hollow interior of tank 14 between electrical assembly 152 inside of recess 86 and batteries 52 and the assemblies requiring power including but not limited to drive wheel 66, scrubbing member 70, the vacuum system, solenoid valves, and the like. In addition to allowing routing of harnesses 156 and 160 within the confines of tank 14, the material forming passages 154 and 158 provide structural integrity to tank 14.

Recesses 86 and 130 are advantageous in providing an unobstructed operator stand for both aesthetic and functional reasons. Specifically, a primary challenge in the design of any floor treating equipment is to make the machine as compact as possible to maximize maneuverability. In floor treating equipment where a solution is applied and/or removed from the floor such as for floor scrubbers 10, there is a need to provide solution and recovery tanks 14 and 16 as large as possible so that the productivity rate can be as high as possible. Because of the balancing of making the machine as small as possible and tanks 14 and 16 as large as possible, there is a need to utilize every possible machine space and minimize any wasted space. Additionally, it is conventional to provide a separate and distinct compartment for electrical components. Such compartments can then be located above or below the main structure of the machine which would be in the area of the support/traction wheel centerline to the wheels' upper height or in other words generally above or below chassis 18. When located below the main structure of the machine, the electrical component compartment rarely imposed restrictions on tank capacity as the tank bottoms are generally above this level. However, positioning the electrical component compartment below the main structure made access to the electrical components extremely difficult and placed the compartment close to the floor, increasing the risk of contaminants getting into the compartment and increasing the possibility of component failure. Prior separate and distinct electrical component compartments above the main structure generally required the machine to become physically larger or reduced the tank capacity over and beyond the volume of the separate electrical component compartment. It should then be appreciated that while the capacity of tank 14 is reduced by the volume of recesses 86 and 130 in the preferred form of the present invention, the volume that the tank capacity is reduced is equal to the required volume for recesses 86 and 130 to hold the necessary electrical components, thereby minimizing packaging inefficiencies and thus minimizing the physical size of floor scrubber 10 and maximizing capacity of tank 14 according to the teachings of the present invention. Since walls 132, 134, 136, 142, 144, 146 and 148 forming recesses 86 and 130 are integral with tank 14 according to the teachings of the present invention, overall fabrication costs are reduced as the material and labor for forming tank 14 is the same whether or not recesses 86 and 130 are present, but recesses 86 and 130 which make up five sides of the respective enclosures for holding the electrical components reduce the number of parts required and thereby eliminating the costs associated with forming such parts and assembling such parts into the final assembly. Additionally, tank 14 and in particular the solution for treating the floor surface contained in tank 14 can act as a heat sink for removing heat generated by electrical assembly 152. Furthermore, providing first and second recesses 86 and 130 rather than a single large recess is believed to be advantageous for several reasons. First, the size of panel 138 can be minimized to easily fit in the top wall of side portion 126 and not be excessive length in the forward movement and viewing direction to allow panel 138 to be angled from the horizontal direction at a relatively large acute angle and be positioned within the forward extent of side portion 26. Additionally, the electrical components in recess 130 are generally removed from and thus insulated from the electrical components of electrical assembly 152, some of which generate a relatively large amount of heat.

In the most preferred form, the upper wall 25 of lower portion 24 which extends generally parallel to the floor surface and upon which the operator's feet can be supported is planar and specifically is generally free of obstruction from middle portion 29 to a front edge of lower portion 25 and from the expansion of side portion 26 to an opposite side edge. Thus, the operator sitting upon seat 12 has a relatively unobstructed view in the forward direction and is able to see the right forward corner of tank 14 and of scrubber 10 for purposes of maneuvering scrubber 10 adjacent to walls and other obstructions in operation of scrubber 10 according to the teachings of the present invention.

In the most preferred form, clean solution tank 14 has a lateral extent greater than chassis 18 and in the most preferred form to an extent generally equal to the outer extent of wheels 23 on axle 22 and of scrubbing member 70. The bottom of clean solution tank 14 includes a recessed portion 35 for receipt of chassis 18. In particular, recessed portion 35 includes a first portion formed in the bottom of lower portion 24 and of middle portion 29 of a shape corresponding to and for receipt of rail portions 36 and 38, lateral rail 54 and plate extension 64. Recessed portion 35 further includes second and third portions formed in the bottom of side portions 26 and 28 for receipt of rails 32 and 34. Thus, the bottom of clean solution tank 14 has a lower extent generally equal to the lower extent of plate 20 and extension 64 and extends around and outside of chassis 18. Thus, the bottom of clean solution tank 14 includes first and second volumes 88 having generally triangular shapes in horizontal cross section having inside walls generally corresponding to portions 36 and 38 and bottom walls at a vertical height corresponding to plate extension 64 and the lower edges of portions 36 and 38. It should then be appreciated that due to the tricycle shape of chassis 18 and recessed portion 35 of clean solution tank 14 resulting in volumes 88, the capacity of solution tank 14 and thus the amount of clean solution that can be held therein is maximized. In the most preferred form, volumes 88 represent an increase of approximately 20% of the capacity of clean solution tank 14 which represents a significant operation advantage for scrubber 10.

In the most preferred form, recovery tank 16 is removably mounted to and carried by chassis 18 and clean solution tank 14 and in the most preferred form is vertically and laterally arranged. Specifically, tank 16 is removably attached to tank 14 and extends between the rear ends of side portions 26 and 28 of tank 14 in the preferred form. Particularly, in the most preferred form, recovery tank 16 includes forwardly extending first and second projections 41 having lower edges adapted to abut with ledge 80 of side portion 26 and the upper wall of side portion 28. Projections or brackets 42 are suitably separately or integrally formed in pockets in projections 41 and which can be removably inserted into corresponding recesses 44 of ledge 80 and the upper wall of side portion 28. The bottom of recovery tank 16 includes a lower lip portion 46 for abutting with and being supported on plate 20 adjacent its rear edge.

It should then be appreciated that recovery tank 16 is supported at three locations, specifically at the abutment of lip portion 46 with plate 20 and the abutment of projection 41 with side portions 26 and 28, with the majority of the weight being carried by abutment of lip portion 46 with plate 20 and thus being carried directly by chassis 18 rather than through clean solution tank 14. Thus, clean solution tank 14 is not subject to fatigue from carrying recovery tank 16. The major function of brackets 42 inserted in recesses 44 is to keep recovery tank 16 in a vertical orientation and specifically to keep recovery tank 16 from tipping on plate 20 away from clean solution tank 14 and from moving laterally relative to tank 14. Brackets 42 are not intended to engage recess 44 in a manner to support tank 16. The three location support of recovery tank 16 is also advantageous in reducing fatigue stresses placed on tank 16.

In the most preferred form, recovery tank 16 includes a vacuum assembly 200 such as of the type shown and described in U.S. Pat. No. 5,829,095, which is hereby incorporated herein by reference, but in an inverted arrangement for purposes of drawing air from the hollow interior of recovery tank 16. Particularly, the upper portion or top of tank 16 generally includes four integral regions, specifically a turbine mount region 202, an inlet region 204, an access region 206, and a safety float shutoff region 208. Vacuum assembly 200 includes suitable provisions 210 such as a vacuum motor turbine for creating air flow and in the most preferred form includes an enclosed fan 212 having a vacuum inlet and a vacuum outlet and which is rotated by a drive such as a battery powered electric motor 214 including an integral fan for moving cooling air. Region 202 includes an integral socket 216 of a size for slideably receiving turbine 210. A cooling air conduit or passage 218 intersects with socket 216 and extends to an exterior location of tank 16 such as the front face thereof. In the most preferred form, the front face of tank 16 includes channels which provide structural rigidity to the front face of tank 16 and to tank 16 and with which passage 218 intersects to allow air flow in the channels such as behind seat 12 and batteries 52 which may abut or be closely adjacent to the front face of tank 16. The bottom of cooling air passage 218 in the most preferred form angles downwardly such that any solution from leakage, condensation or the like will tend to drain from passage 218. The end of motor 214 abuts with the bottom of socket 216, is of a size which generally does not pass into passage 218, and includes an inlet for cooling air in fluid communication with passage 218. A foam gasket 220 is received in socket 216, receives motor 214 and acts as a barrier between the cooling air inlet in the end of motor 214 and the cooling air outlet in the side of motor 214 spaced above the end of motor 214 and below the vacuum outlet of fan 212. Passage 218 extends from the exterior of tank 16 to socket 216 on the opposite side of gasket 220 than the cooling air outlet of motor 214.

Socket 216 in the preferred form of the present invention includes a radially extending pocket 222 extending from the upper surface of region 202 to an exterior position of tank 16 such as the bottom surface of projection 41 in the most preferred form, with the vacuum outlet of fan 212 located in pocket 222. Hose 40 extends from the exterior of tank 16 into pocket 222 and is suitably attached to and in fluid communication with the vacuum outlet of fan 212. In the most preferred form, the portion of tank 16 which abuts with the rear ends of side portion 26 of tank 14 includes a semi-cylindrical channel 224 for receipt of hose 40. In the most preferred form, an acoustical foam muffler 226 is secured to the free end of hose 40 for muffling sounds exiting hose 40.

Inlet region 204 is in the form of a spiral extending generally concentrically with socket 216. An inlet 228 extends generally horizontally from the rear of inlet region 204 and to which an inlet hose 230 in fluid communication with squeegee assembly 60 can be connected. In the most preferred form, the rear wall of tank 16 can include a semi-cylindrical recess for receiving hose 230. In the most preferred form, suitable provisions are provided to allow inlet 228 to be removed from fluid communication with squeegee assembly 60 and to be connected to be in fluid communication with a manual wand.

Access region 206 generally includes a planar top having an access opening 234 from which a skirt 235 downwardly extends. Safety float shutoff region 208 generally includes a planar top including a shouldered opening 236.

According to the preferred teachings of the present invention, vacuum assembly 200 further includes a multi-purpose vacuum duct 240 which defines a hollow interior and which is secured to the top of tank 16. Vacuum duct 240 is generally P-shaped and has a head extending over region 202 including socket 216 and over region 204 and a leg extending over the front portion of region 206 and over region 208. A multiple step passage 242 integrally extends between the top and bottom walls of duct 240 in the head of the P-shape of duct 240 and generally aligned with socket 216, with the bottom wall of duct 240 abutting with the top of tank 16 when duct 240 is secured thereto. Specifically, passage 242 includes a downwardly facing shoulder 244 against which a foam gasket 246 abuts. Foam gasket 246 is in a sealing relation between fan 212 and the bottom wall of duct 240. In the most preferred form, the distance from the bottom wall of socket 216 to shoulder 244 is generally equal to the height of turbine 210 such that turbine 210 is sandwiched therebetween so that physical connection or securement of turbine 210 to tank 16 and/or duct 240 such as by bolts is not necessary. Thus, assembly of turbine 210 into tank 16 can be rapidly accomplished by simply placing turbine 210 into socket 216. The inlet of fan 212 is located within passage 242 with gasket 246 assuring optimization of airflow efficiency.

Passage 242 further includes a lower, upwardly facing shoulder 248 vertically spaced from shoulder 244 opposite to the bottom wall of duct 240 for supporting a filter or screen 250 in passage 242, with screen 250 preventing objects from entering the vacuum inlet of fan 212. A porous foam filter 252 is supported on screen 250 in passage 242, with foam filter 252 filtering finer objects or impurities such as lint from entering the inlet of fan 212. In the most preferred form, passage 242 includes a mold-in core hole located intermediate shoulders 244 and 248. In particular, the molded-in core includes a lower annular surface that is generally smooth and planar and which terminates in a central opening concentrically located in passage 242. The molded-in core includes an upper annular surface which is smooth but interrupted by integral dividers extending radially from the central opening to the outer wall of passage 242 and having upper surfaces which angle vertically upwardly from their inner edges to their outer edges. Thus, the upper side of molded-in core includes pie shaped cavities open in their inner and upper sides for directing air to the central opening and to the inlet of turbine 210.

Passage 242 further includes an upper, upwardly facing shoulder 254 of a radial size larger than shoulder 248. A lid or cover 256 having a suitable gasket on the underside thereof to create a vacuum seal is removably supported upon shoulder 254 and closes passage 242, with cover 256 being spaced from shoulders 244 and 248 and filters 250 and 252. Cover 256 can be removed from passage 242 for inspecting and/or cleaning of filters 250 and 252. An inlet opening 258 is formed in passage 242 and thus in the head of the P-shaped duct 240 and is in fluid communication with the vacuum inlet of turbine 210. In the preferred form, inlet opening 258 is located intermediate shoulders 244 and/or 248 and shoulder 254 and cover 256 supported thereon and in particular intermediate filter 252 and shoulder 254 and cover 256 to allow air flow between the hollow interior of duct 240 and passage 242.

A skirt 260 integrally extends around a float opening and downwardly from the bottom wall of duct 240 adjacent to the free end of the leg of the P-shape of duct 240 and generally aligned with opening 236 of tank 16. A safety float shutoff cage 262 is suitably secured to skirt 260 and contains a suitable float 264, with skirt 260, cage 262 and float 264 forming a safety float shutoff carried by duct 240. Float 264 will float on solution in tank 16 and seat inside of skirt 260 to prevent turbine 210 from drawing in solution into duct 240 in the event that solution is present in tank 16 beyond a desired capacity. Suitably sealing provisions are provided between skirt 260 and opening 236 to create a vacuum seal between duct 240 and tank 16. Thus, the safety float shutoff is in fluid communication with the hollow interior of duct 240 and extends through float opening 236 of tank 16 in a sealed manner.

Suitable hinge tabs 266 are integrally formed on the upper wall of the leg of the P-shape of duct 240. Vacuum assembly 200 further includes a cover 268 of a hollow construction for receipt in and for closing opening 234. Suitable provisions such as a gasket are provided to create a vacuum seal between cover 268 and tank 16. In the most preferred form, cover 268 includes integral cylindrical protrusions or hinge pins that can be retained by a retainer 270 on hinge tabs 266 to pivotably attach cover 268 to duct 240. Cover 268 can be hinged for inspection and/or cleaning of the hollow interior of recovery tank 16.

In the most preferred form, cooling air passing from motor 214 can pass between turbine 210 and socket 216, with socket 216 being shaped so that turbine 210 does not mate in a sealing manner with socket 216. Cooling air passing from motor 214 can also pass from socket 216 into pocket 222. Cooling air can pass from socket 216 and pocket 222 in clearance spaces around hose 40 and in clearance passages formed in the bottom wall of duct 240 which abuts with the upper wall of region 202 of tank 16.

It should be appreciated that vacuum duct 240 according to the preferred teachings of the present invention serves multiple purposes. Specifically, duct 240 retains, protects, and covers turbine 210. Integral passage 242 of duct 240 retains filters 250 and 252 for the airflow to the inlet of turbine 210. Integral skirt 260 of duct 240 mounts shutoff cage 262. Integral hinge tabs 266 of duct 240 form a portion of the hinge for hingedly connecting cover 268 to duct 240 and thus to recovery tank 16.

Additionally, hollow duct 240 according to the preferred teachings of the present invention provides ducting for the airflow from shutoff cage 262 to inlet opening 258 in passage 242 in a manner to allow any residual solution retained in the airflow to drop out before entering inlet opening 258 and the inlet of turbine 210. In particular, inlet opening 258 is located generally on the opposite side of duct 240 and recovery tank 16 than shutoff cage 262 to maximize the travel distance. Further, the inside cross-sectional size or volume of the hollow interior of duct 240 becomes larger from shutoff cage 262 to inlet opening 258. Thus, the relative velocity of the airflow entering skirt 260 will drop when flowing into increasing volume. Moisture carried by airflow will tend to drop out of the airflow when the velocity of the airflow decreases. Furthermore, it is necessary for the airflow to change direction a number of times before it reaches the inlet of turbine 210. In particular, the direction of the air flow from the hollow interior of tank 16 and entering skirt 260 of the safety float shutoff into duct 240 will be generally vertical and changes to generally horizontal inside of duct 240, with the largest mass of air traveling adjacent the bottom wall of duct 240. The airflow must move upward when it reaches the inside surface of passage 242 and flows into inlet opening 258. Once the airflow enters inlet opening 258, it is forced to travel generally vertically downward through filters 250 and 252 before it reaches the inlet of turbine 210. (For sake of completeness, the air flow travels from the vacuum inlet of fan 212, through fan 212 and the vacuum outlet of fan 212 and to and through exhaust hose 40 and muffler 226.) The change in direction of the airflow also has the tendency to drop out moisture by centrifugal forces. It should be appreciated that moisture particles carried by the airflow can have a detrimental effect on turbine 210, and it is desired that as much moisture is removed from the air flow in duct 240 according to the teachings of the present invention before it reaches turbine 210. Any moisture which collects inside of duct 240 will easily drain back into recovery tank 16 through skirt 260 when turbine 210 is not operating.

Although duct 240 performs multiple purposes according to the preferred teachings of the present invention, it is formed as a single, integral component utilizing a rotational molding process. It should be appreciated that the cost of fabricating duct 240 is not dramatically increased by inclusion of relatively complex features in the exterior portions of duct 240. However, the inclusion of such relatively complex features in the exterior portions of duct 240 significantly reduces the need for separate components for performing such functions, which separate components having associated fabrication, inventory, and assembly costs which are eliminated with duct 240 according to the preferred teachings of the present invention. Further, general serviceability is improved as floor scrubber 10 according to the preferred teachings of the present invention includes fewer components to remove and replace when servicing is required. Furthermore, overall machine component packaging of floor scrubber 10 according to the preferred teachings of the present invention is maximized for efficiency, as the complex features and details added to duct 240 in the molding process aid in minimizing wasted and unused space.

Similarly, cover 268 includes the integral cylindrical protrusions forming a portion of the hinge of the hinged connection between cover 268 and duct 240 and thus recovery tank 16. Such cylindrical protrusions are received in recessed areas of hinge tabs 266 of duct 240 which provide downward, forward, and aft retention of the cylindrical protrusions and fully retained therein by the securement of retainer 270 to duct 240. In addition to closing access opening 234, cover 268 has a size and shape so when hingedly connected to duct 240 and closing access opening 234, cover 268 completes the P-shape of duct 240 and thereby with duct 240 create a D-shape generally corresponding to the top of recovery tank 16, with the top walls of the head of duct 240 and of cover 268 being generally coextensive. Thus, formation of cover 268 as a single, integral component to define a hollow interior and utilizing a rotational molding process according to the preferred teachings of the present invention is similarly advantageous as with duct 240.

Likewise, tank 16 according to the preferred teachings of the present invention including integral regions 202, 204, 206 and 208 having integrally formed socket 216, conduit 218, pocket 222, channels including channel 224, skirts 234, and the like similarly formed as a single, integral component to define a hollow interior and utilizing a rotational molding process according to the preferred teachings of the present invention is similarly advantageous as with duct 240 and cover 268. Furthermore, inlet region 204 in the form of a spiral extending concentrically with socket 216 directs airflow and the solution carried thereby at a relatively large distance and in a direction away from skirt 260. Thus, the solution will have a greater tendency to drop out of the airflow than to travel with the airflow into skirt 260.

It should then be appreciated that the arrangement of recovery tank 16 and clean solution tank 14 according to the teachings of the present invention is advantageous. Specifically, recovery tank 16 can be removed from scrubber 10 (after removal of any electrical connection to the vacuum assembly provided and disconnection of hose 40) by simply lifting recovery tank 16 to raise brackets 42 from recesses 44. This is advantageous as once removed, recovery tank 16 can be tilted or canted to swivel solution therein for removing sediment that may have built up in the bottom of tank 16.

Further, with recovery tank 16 removed according to the preferred teachings of the present invention, rear access is available to battery pack 52 supported upon chassis plate 20. Thus, battery pack 52 can be easily slid into and out of the battery compartment defined by plate 20, side portions 26 and 28 and middle portion 29. Additionally, for increased accessibility, plate 82 and seat 12 can be pivoted to provide vertical access to battery pack 52. In particular, it is not necessary to raise battery pack 52 in a vertical direction for removal. Removal of battery pack 52 is necessary for servicing and may be desirable to allow recharging of the batteries while scrubber 10 is being operated on a fresh battery pack 52. Further, battery pack 52 is supported upon plate 20 formed of metal and is not supported in any way by tanks 14 and 16. It, of course, should be realized that access is available to battery pack 52 with tank 16 attached to scrubber 10 by pivoting plate 82 and seat 12 according to the teachings of the present invention whether or not recovery tank 16 is removed.

Scrubber 10 according to the preferred teachings of the present invention is especially advantageous for applications having a relatively small cleaning width while having the operator being supported in a sitting position. Specifically, scrubber 10 in the most preferred form has a total width that is able to pass through conventional doorways without requiring disassembly and is able to maneuver in smaller, tighter applications. In particular, the particular shape and relationships of tanks 14 and 16 with each other and with battery pack 52 is advantageous in reducing the overall size of scrubber 10 to a minimum to fit through conventional doorways but to maximize the volume of tanks 14 and 16 so that refilling is not necessary for a typical battery run with scrubber 10. The intended application of scrubber 10 according to the preferred teachings of the present invention should be acceptable even if tanks 14 and 16 are more exposed to the environment.

Included in the ability to maneuver in smaller, tighter applications, floor scrubber 10 according to the preferred teachings of the present invention has the ability to clean up to a wall, divider, or similar vertical surface V, to sharply turn away from surface V when necessary such as at corners, to avoid obstacles and the like and to minimize the area of the floor surface which is not treated. Scrubbing member 70 of floor scrubber 10 according to the preferred teachings of the present invention extends beyond the lateral extent of the outside wall defining right side portion 28 and lower portion 24 by a distance D, with scrubbing member 70 in the preferred form having the same lateral extent or in other words is generally flush with the outside wall defining left side portion 26 and the expansion thereof. In this regard, scrubbing member 70 includes bumper wheels 69 that are able to follow along and roll on surface V. Extending scrubbing member 70 beyond the lateral extent of chassis 18 and only on one side, the right side, is a conventional approach to allow scrubbing under underhangs formed on surface V, to allow the operator to observe bumper wheels 69 following along surface V and to minimize the potential contact area of floor scrubber 10 to surface V.

Solution pickup assembly in the form of squeegee assembly 60 shown has a lateral extent generally equal to but slightly larger than scrubbing member 70. When not engaging surface V or other obstacle and in a normal cleaning mode, squeegee assembly 60 extends beyond the lateral extent of the outside wall defining right side portion 28 and lower portion 24 by a distance S, with distance S being at least equal to and preferably greater than distance D. Similarly, squeegee assembly 60 extends beyond the outside wall defining left side portion 26 and the expansion thereof and of the left end of scrubbing member 70 in the preferred form generally equal to the difference in distances S and D. In the most preferred form, squeegee assembly 60 includes bumper wheels 61 that are able to follow along and roll on surface V. Squeegee assembly 60 typically has a width greater than scrubbing member 70 in order to pick-up solution when floor scrubber 10 moves in the forward movement direction along a non-linear path. Suitable provisions such as longitudinally extending flexible skirts attached to scrubbing member 70 to contain the solution when floor scrubber 10 moves along a non-linear path can be provided to minimize the difference between distances D and S. According to the preferred teachings of the present invention, squeegee assembly 60 is suitably mounted to move laterally from side-to-side relative to chassis 18 and in particular to allow distance S to equal distance D when floor scrubber 10 is utilized to treat the floor surface up to surface V and according to the teachings of the present invention to allow distance S to be minimized and approach a zero value or in other words that bumper wheels 61 and the end of squeegee assembly 60 on one or the other of the sides of floor scrubber 10 has the same extent as the outside walls of side portions 26 and 28.

It should be appreciated that tanks 14 and 16 have an outer perimeter parallel to the floor surface which defines the left side, front and rear of the generally rectangular profile parallel to the floor surface of floor scrubber 10 and in particular the assemblage carried by the chassis 18 for treating the floor surface including but not limited to tanks 14 and 16, squeegee assembly 60, and scrubbing member 70 in the most preferred form. The right side of the outer perimeter of tanks 14 and 16 is inset slightly from the right side of the generally rectangular profile which is defined by the end of scrubbing member 70 extending beyond the right side of the outer perimeter of tanks 14 and 16 in the most preferred form. Seat 12 and steering assembly 74 are within the outer perimeter of tanks 14 and 16 and thus within the generally rectangular profile of machine 10.

It should be appreciated that when the axis of drive wheel 66 is parallel to axle 22, floor scrubber 10 will move linearly with wheels 23 and 66 moving at identical rates of speed. However, when drive wheel 66 which is spaced from axle 22 is turned, the axis of wheel 66 will intersect the axis defined by axle 22 of wheels 23 at a rotation pivot point P. Thus, when wheel 66 is turned 90° from a parallel condition to axle 22, which represents the maximum amount of turning possible, rotation pivot point P is located on axle 22 equidistant between wheels 23 and thus of chassis 18. When rotation pivot point P is equidistant between wheels 23 and as wheels 23 are independently rotatable about axle 22, the outside wheel 23 on the turn will rotate forward and the inside wheel 23 on the turn will rotate rearward at the same rate as the outside wheel 23. It should be appreciated that the tricycle arrangement of wheels 23 and 66 has particular advantages in the ability to turn such that rotation pivot point P is located equidistant between wheels 23 without complicated turning linkages or mechanisms. However, it is possible to utilize a four wheel or similar arrangement according to the teachings of the present invention where floor scrubber 10 can be turned in a manner that rotation pivot point P is located generally equidistant between wheels 23.

According to the teachings of the present invention to minimize the minimum aisle turn width or, in other words, the minimum width that floor scrubber 10 can turn 180°, axle 22 must be positioned such that any point along the sides and rear of the generally rectangular profile of floor scrubber 10 behind axle 22 and in the quadrant on the same side that scrubbing member 70 extends should be at a distance R generally equal to or less than the lateral spacing W of rotation pivot point P from the maximum extent of scrubbing member 70 or in other words the spacing of rotation pivot point P from the outer extent of side portion 28 along axle 22 plus distance D. The intersection I between the rear and right side wall of tank 16 is radiused in the preferred form to allow the spacing of rear wall from the front wall to be maximized in order to maximize the volume of tank 16, with radiused intersections I defining the greatest spacing of the rectangular profile on the opposite side of axle 22 from wheel 66 in the preferred form. In the most preferred form, the intersection between the rear and left side wall of tank 16 is radiused for symmetrical appearance reasons. However, in the preferred form, the maximum spacing of the rear wall of tank 16 perpendicular to axle 22 from rotation pivot point P is less than distance R to truncate the total length of floor scrubber 10 to fit in elevators, trailers, and the like. In the most preferred form, it is desired that distance R which represents the rear swing distance should be at least equal to spacing W or just slightly greater than and specifically within a range of 2 percent greater than spacing W to maximize the volume of tank 16 while still preventing intersection I from hitting surface V when turning floor scrubber 10 away from surface V. It should be appreciated that if distance R is greater than spacing W, intersection I will engage surface V requiring that floor scrubber 10 be positioned away from surface V a distance before drive wheel 66 can be turned its maximum to prevent contact with surface V. Thus, floor scrubber 10, according to the preferred teachings of the present invention, is able to easily clean up to and turn away from surface V without contact with surface V.

According to the preferred teachings of the present invention, floor scrubber 10 also includes provisions allowing it to be turned 180° between spaced surfaces V and/or closely adjacent a corner between interconnecting surfaces V in an aisle turn width T of a minimum length. In particular, front swing distance F which represents the greatest distance of the front of floor scrubber 10 from rotation pivot point P is desired to be as small as possible. Width T of a minimum size would be when front swing distance F is equal to distance R or in other words, if a horizontal profile was of a circular shape. However, this circular profile is impractical, especially for floor scrubbers 10 intended to be ridden, due to overall space and packaging requirements. Thus, floor scrubbers 10, especially which are intended to be ridden, to be commercially viable are generally of a rectangular shape. In order to maximize the length of floor scrubber 10 and in the most preferred form to maximize the volume of lower portion 24 and the expansion of side portion 26 and in order to minimize width T, distance F at its maximum is at a front location or point G generally perpendicular to axle 22 from rotation pivot point P when floor scrubber 10 is at its maximum turning angle which is at the lateral center of lower portion 26 and intermediate the outer walls of side portions 26 and 28 in the most preferred form of the present invention. Particularly, the intersections J of the front edge and side edges of lower portion 24 are radiused to be equal to or within an arc having a radius equal to distance F from rotation pivot point P at the maximum turning angle at point G of floor scrubber 10 and in the most preferred form is radiused such that the front of the generally rectangular profile defined by intersections J is radiused from point G at distance H from rotation pivot point P which is less than distance F. In still further preferred forms of the present invention, the front wall of the expansion of side portion 26 is arched rearward from its lower edge to its upper edge for aesthetic reasons in following the radiused intersections J and for aiding the operator in estimating whether floor scrubber 10 can be turned within an aisle or similar spaced obstacles.

In the case of floor scrubber 10 and similar floor treating machines where solution is desired to be movably supported by chassis 18, it is desired to maximize tank capacity to increase machine efficiency and thus increase the physical size of tanks 14 and 16 as much as possible. However, in order to be commercially viable, the total length L of floor scrubber 10 must be able to fit within elevators, transport trailers, and the like, with this parameter being especially important in smaller, tighter applications as treating floor surfaces by machines in which the operator rides were not considered due to their prior unavailability. In this environment, it is desired to maximize the maneuverability of floor scrubber 10, which can be accomplished when the aisle turn width which according to the preferred teachings of the present invention is equal to the sum of distances F and R is generally equal to the length L of floor scrubber 10 and in particular is as close to equal as possible and specifically is less than 5 percent of the sum of distances F and R. Further, minimizing the size of chassis 18 to be as small as possible and utilizing tanks 14 and 16 to form the outer perimeter of floor scrubber 10 according to the teachings of the present invention maximizes tank capacity to increase machine efficiency while minimizing overall machine size necessary for smaller, tighter applications. Prior riding floor scrubbers, which were not intended for the smaller, tighter applications as floor scrubber 10 of the present invention, generally had lengths which were as low as 9 percent greater than the aisle turn distance and typically in the range of 20 percent or larger greater than the aisle turn distance. The generally equal relationship between the aisle turn width and length L and the relationship between tanks 14 and 16 and chassis 18 are important to allow floor scrubber 10 according to the teachings of the present invention to be maneuverable in smaller, tighter applications which were not previously considered possible in prior riding floor scrubbers.

Clean solution tank 14 includes a solution discharge port 15 to allow controlled gravitational release of solution from tank 14 to the floor surface at or in front of scrubbing member 70 in any conventional manner. It can then be appreciated that clean solution does not have the contaminants which can develop between growth and odors as does solution recovered from the floor surface, and that it is not necessary for clean solution tank 14 to be cleaned and flushed out as does recovery tank 16. Thus, clean solution tank 14, according to the teachings of the present invention, can be molded in a complex shape or form to maximize strength and to best utilize spaces in scrubber 10 to maximize solution volume. This is especially advantageous for scrubbers 10 having a relatively narrow cleaning width as the space required for tank 14 containing clean solution is one of the important factors in determining the physical size of scrubber 10. In this regard, clean solution tank 14 can be fabricated in a manner creating pockets which hold solution but which is unable to be drained, but with the pockets being necessary in the fabrication of tank 14 for strength reasons.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A machine for treating floor surfaces utilizing a solution comprising, in combination: a chassis movably supported on the floor surface, with the chassis including a chassis plate spaced from and generally parallel to the floor surface and having first and second sides; first and second side tank portions extending on opposite sides of the chassis plate adjacent to the first and second sides of the chassis plate and having first ends, with the first and second side tank portions defining a hollow interior for containing the solution for treating the floor surface, with the first side portion having a vertical height slightly greater than the vertical height of the second side portion, with the first side portion including a recess defining a shoulder at the vertical height of the second side portion; a middle portion extending between the first and second side portions and spaced from the first ends, with the middle portion including an upper surface having a vertical height equal to the vertical height of the second side portion; an operator seat having a first side, a second side and an edge extending between the first and second sides; and an ear integrally extending from the first side of the seat in a direction opposite to the second side and spaced from the edge of the seat, with the ear and the recess having a length considerably shorter than the first side of the seat, with the edge of the seat being pivotally supported on the middle portion, with the second side of the seat being supported on the second side tank portion, with the first side of the seat being supported by the abutment of the ear with the shoulder of the recess, with the seat spanning the first and second side tank portions.

2. The machine of claim 1 wherein the middle portion is a tank portion and integrally extends between the first and second side tank portions, with the first, second, and middle portions defining a single volume.

3. The machine of claim 1 wherein the first side portion includes provisions for adding solution to the hollow interior at a height above the second side portion and the upper surface of the middle portion.

4. The machine of claim 1 wherein the first side portion includes an expansion extending longitudinally past the middle portion and the second side portion terminates in the middle portion.

5. The machine of claim 4 further comprising, in combination: a lower tank portion extending from the middle portion and the expansion and which is generally parallel to the floor surface.

6. The machine of claim 4 with the expansion including a wall, with at least a first recess being integrally formed in the wall and extending into the hollow interior, with the recess defining an open face extending generally coplanar with the wall; with the machine further comprising, in combination: electrical components associated with operating the machine for treating the floor surface, with the electrical components including at least a first electrical harness; at least a first panel removably secured to the expansion for closing the open face of the first recess, with the electrical components being received in the first recess and enclosed in the first recess by the first panel; and at least a first passage integrally extending from the first recess for allowing routing of the first electrical harness through the hollow interior of the expansion.

7. The machine of claim 3 further comprising, in combination: a battery pack for providing power to the machine and supported on the chassis plate between the first and second side portions.

8. A machine for treating a floor surface comprising, in combination: a chassis movably supported on the floor surface; a solution tank carried by the chassis and having a hollow interior for containing a solution for treating the floor surface, with the hollow interior being defined by a wall, with at least a first recess being integrally formed in the wall and extending into the hollow interior, with the recess defining an open face extending generally coplanar with the wall of the tank; electrical components associated with operating the machine for treating the floor surface, with the electrical components including at least a first electrical harness; at least a first panel removably secured to the tank for closing the open face of the first recess, with the electrical components being received in the first recess and enclosed in the first recess by the first panel, and at least a first passage integrally extending from the first recess for allowing routing of the first electrical harness through the hollow interior of the tank.

9. A machine for treating a floor surface comprising, in combination: a chassis movably supported on the floor surface by first and second rear wheels independently rotatable about an axis and at least a first front wheel spaced from the axis; an assemblage carried by the chassis for treating the floor surface, with the chassis, the wheels, and the assemblage having a generally rectangular profile parallel to the floor surface, with the generally rectangular profile having first and second sides, a front, and a rear; a steering mechanism carried by the chassis and located within the generally rectangular profile for steering the front wheel between a forward direction position generally perpendicular to the axis and a maximum turning position generally parallel to the axis, with a rotation pivot point being defined on the axis when the front wheel is in the maximum turning position and about which the chassis rotates when the front wheel is in its maximum turning position, with the rotation pivot point being generally equidistant between the first and second rear wheels and spaced parallel to the axis from the sides of the rectangular profile by a lateral spacing; and a seat carried by the chassis within the generally rectangular profile for supporting an operator, with the axis being positioned in the rectangular profile wherein any location in the rectangular profile on the opposite side of the axis from the front wheel is within an arc from the rotation pivot point of a radius generally equal to the lateral spacing, with the front of the generally rectangular profile having a maximum spacing from the rotation pivot point, with the axis being positioned in the rectangular profile so that the rectangular profile can be turned 180 degrees in a turn width generally equal to the sum of the radius and the maximum spacing.

10. The machine of claim 9 wherein the front wheel is driven.

11. The machine of claim 10 wherein the radius is within a range of 100 to 102 percent of the lateral spacing.

12. The machine of claim 9 wherein the front and rear of the rectangular profile are spaced a machine length, with the machine length being generally equal to the turn width.

13. The machine of claim 9 wherein the turn width is within a range of 100 to 105 percent of the machine length.

14. The machine of claim 9 wherein the maximum spacing of the front is at a front location located generally perpendicular from the axis from the rotation pivot point; and wherein the front of the generally rectangular profile is radiused from the front location to the first and second sides to be spaced from the rotation pivot point less than the maximum spacing.

15. The machine of claim 14 wherein the generally rectangular profile includes radiused intersections between the rear and the first and second sides, with the radiused intersections defining the greatest spacing of the rectangular profile on the opposite side of the axis from the front wheel.

16. The machine of claim 15 wherein the rear of the generally rectangular profile is spaced generally perpendicular from the axis a distance less than the radius.

17. The machine of claim 9 wherein the assemblage includes at least a first tank for holding a solution for treating the floor surface, with the at least first tank having an outer perimeter parallel to the floor surface, with the outer perimeter including first and second sides, a front, and a rear, with the chassis, the wheels, the seat, and the steering mechanism being located within the outer perimeter of the tank, with the second side, front and rear of the outer perimeter defining the second side, front and rear of the generally rectangular profile.

18. The machine of claim 17 wherein the assemblage includes a solution pickup assembly carried by the chassis on the opposite side of the axis than the front wheel and having an end, with the solution pickup assembly being movable relative to the chassis so that the end of the solution pickup assembly extends beyond the first side of the outer perimeter in a cleaning mode and so that the end of the solution pickup assembly is generally coextensive with the first side of the outer perimeter in a turning mode.

19. The machine of claim 17 wherein the assemblage includes a floor surface treating member carried by the chassis intermediate the rear wheels and the front wheel and having an end extending beyond the first side of the outer perimeter, with the end of the floor surface treating member defining the first side of the generally rectangular profile.

20. The machine of claim 19 wherein the floor surface treating member is a floor scrubbing member.

21. The machine of claim 17 with the tank having a hollow interior defined by a wall, with at least a first recess being integrally formed in the wall and extending into the hollow interior, with the recess defining an open face extending generally coplanar with the wall, with the machine further comprising, in combination: electrical components associated with operating the machine for treating the floor surface, with the electrical components including at least a first electrical harness; at least a first panel removably secured to the tank for closing the open face of the first recess, with the electrical components being received in the first recess and enclosed in the first recess by the first panel; and at least a first passage integrally extending from the first recess for allowing routing of the first electrical harness through the hollow interior of the tank.

* * * * *

UNITED STATES PATENT AND TRADEMARK OFFICE

CERTIFICATE OF CORRECTION

PATENT NO. : 6,397,429 B1 
DATED : June 4, 2002
INVENTOR(S) : Donald J. Legatt, Paul T. Mueller, Wolfgang C. Lehmann, Galen Swenson and Patrick Enzler It is certified that error appears in the above-identified patent and that said Letters Patent is hereby corrected as shown below:

Title page,
Item [56], FOREIGN PATENT DOCUMENTS, insert
-- UK 2,274,977 08/1994
DE 9748277 06/1999 --
U.S. PATENT DOCUMENTS, after "4,041,567 A 08/1977 Burgoon 15/320", insert
-- 4,107,813 08/1978 Torres --

Figure 2:
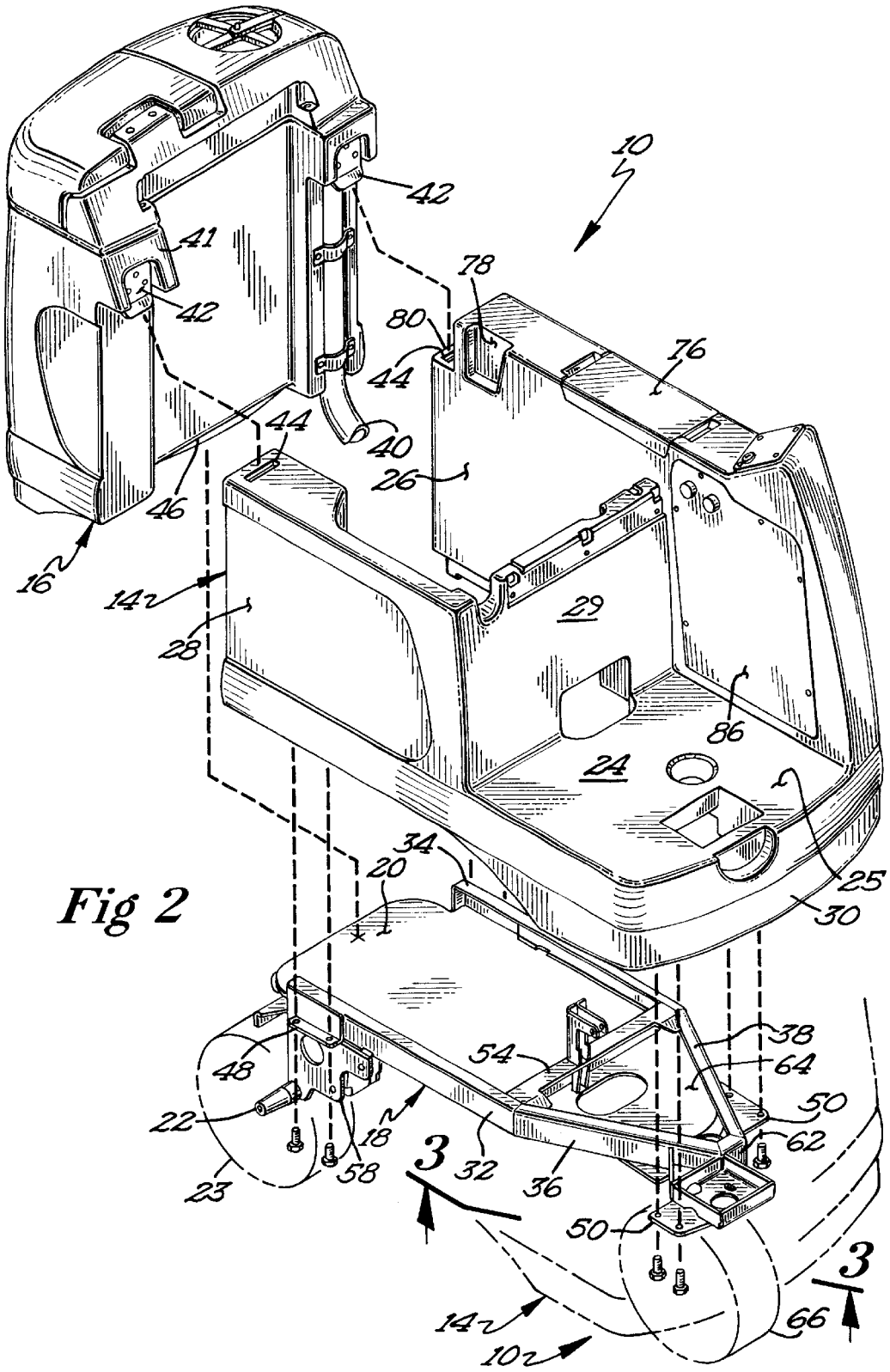
FIG. 2 is an exploded perspective view showing the main components thereof.
Figure 3:
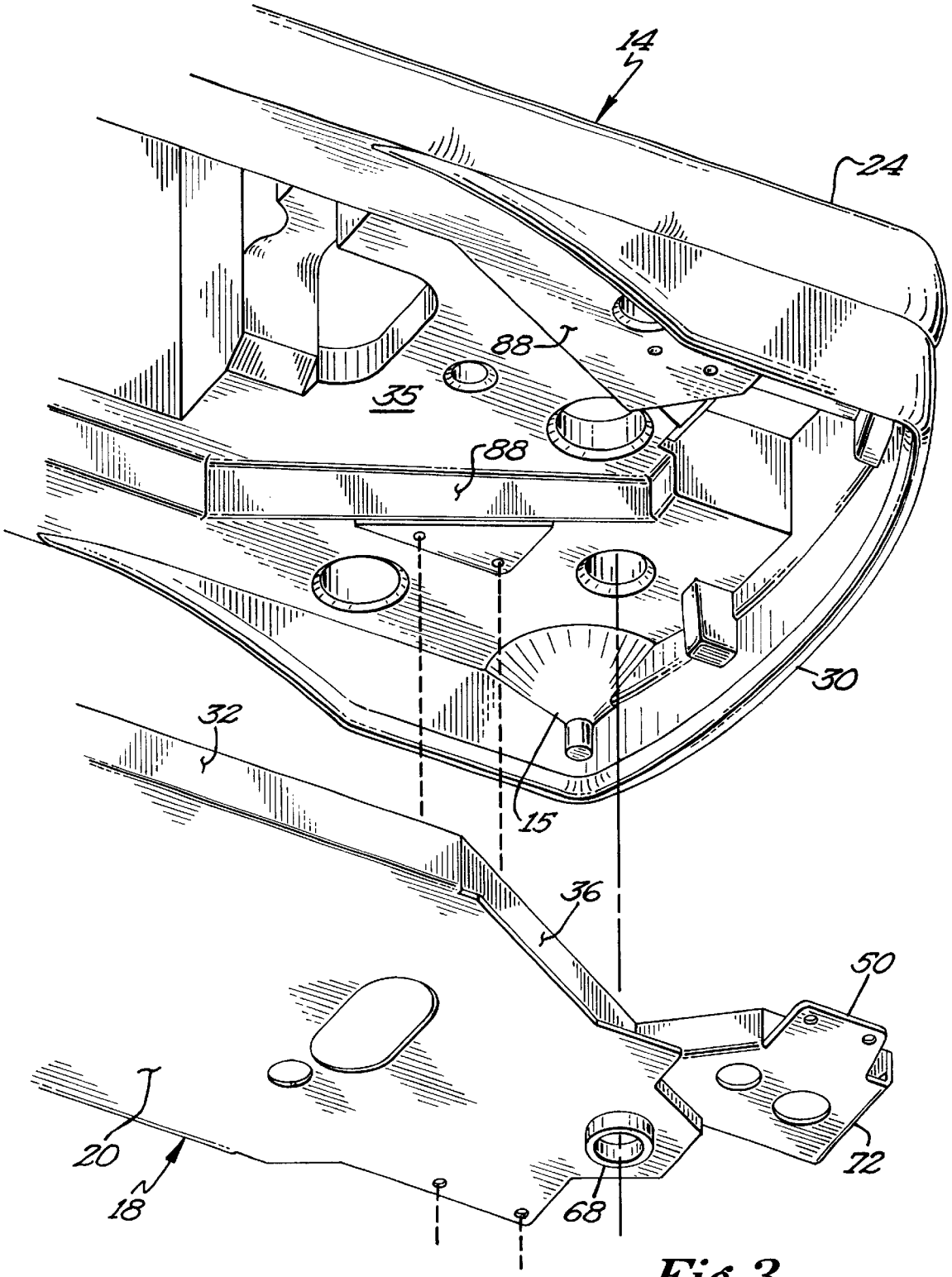
FIG. 3 is a section view taken along line 3—3 of FIG. 2.
Figure 4:
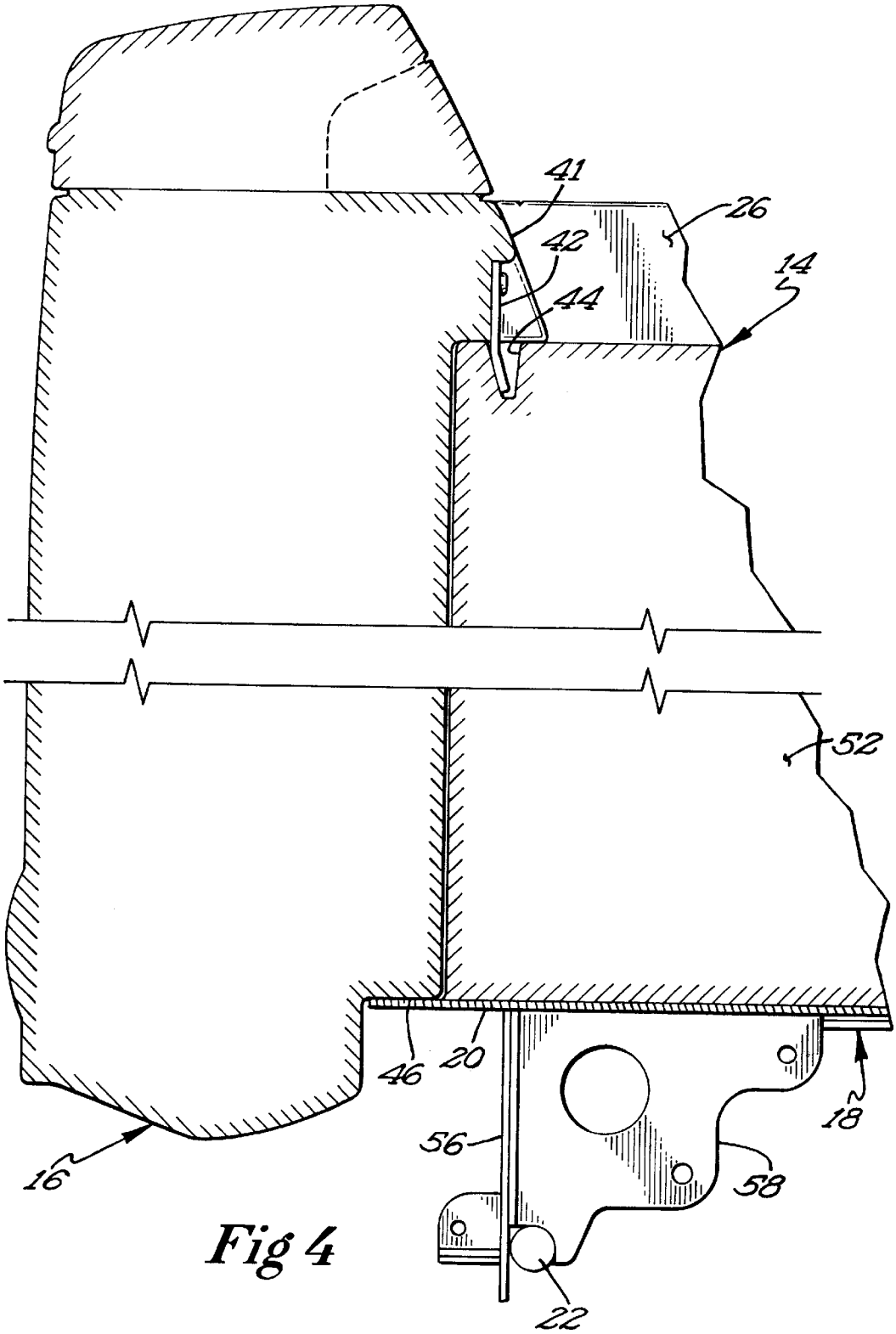
FIG. 4 is a diagrammatic partial side section view of the recovery tank showing the upper and lower attachment points thereof.
Figure 5:
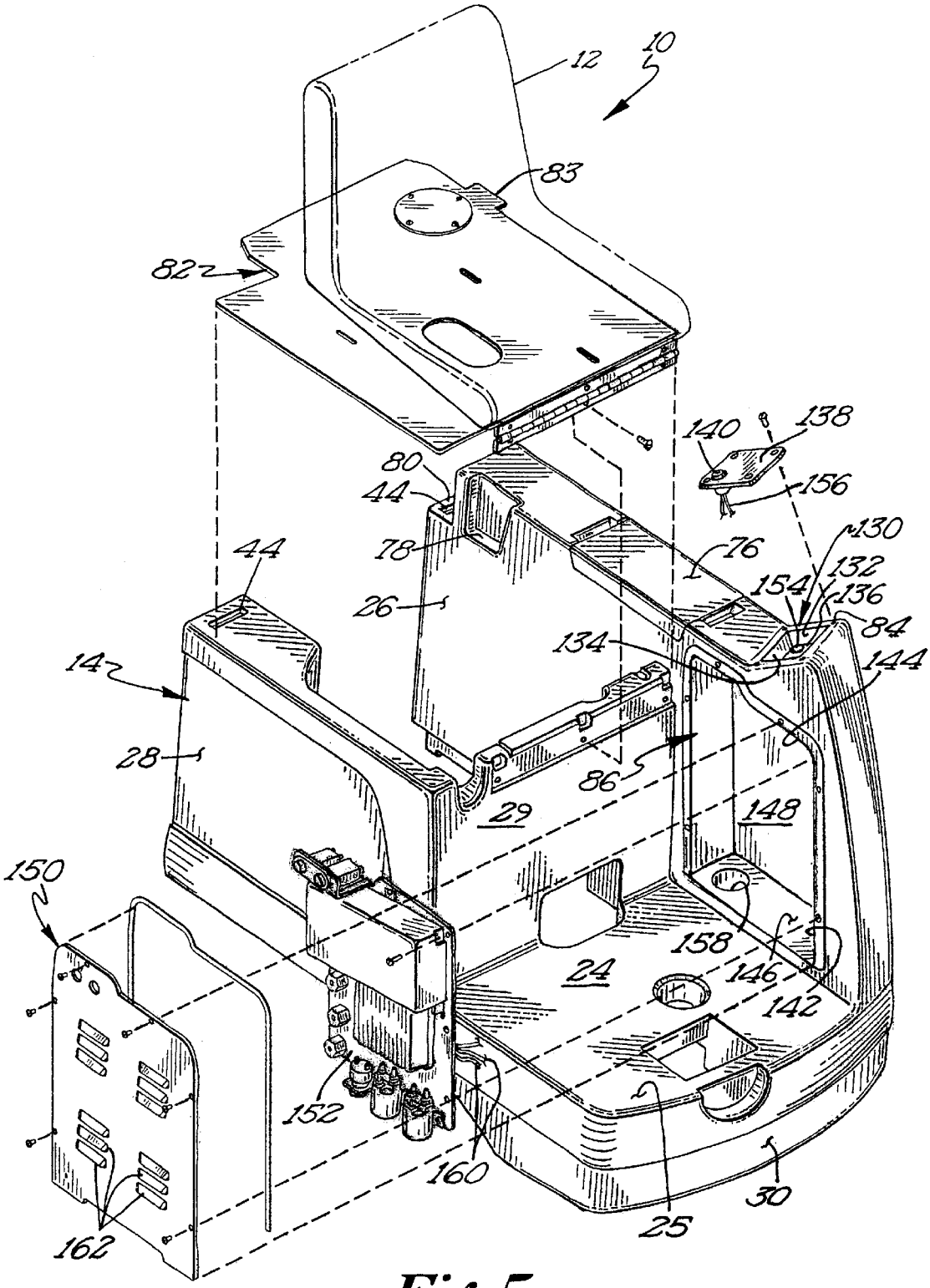
FIG. 5 is an exploded perspective view showing the clean solution tank and some of the components secured thereto.
Figure 6:
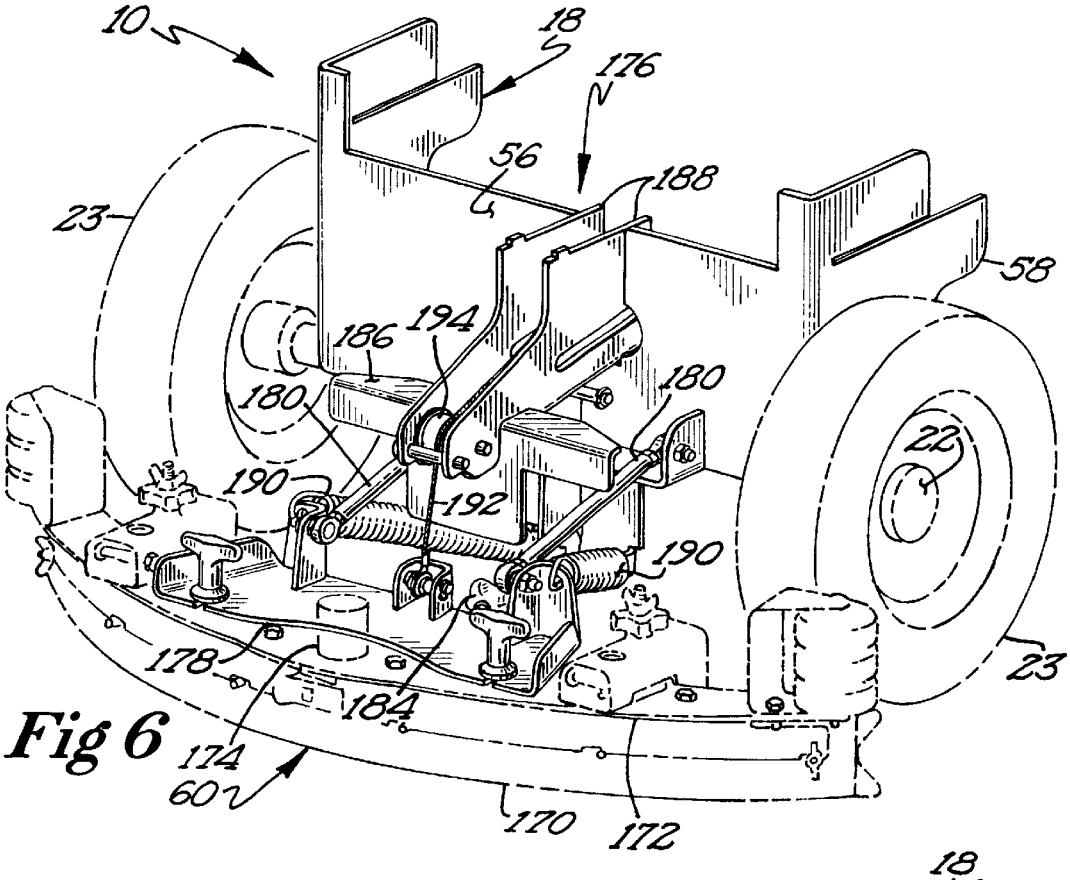
FIG. 6 is a partial, rear perspective view showing the provisions for floating the squeegee assembly on the floor surface, with portions shown in phantom and being broken away.
Figure 7:
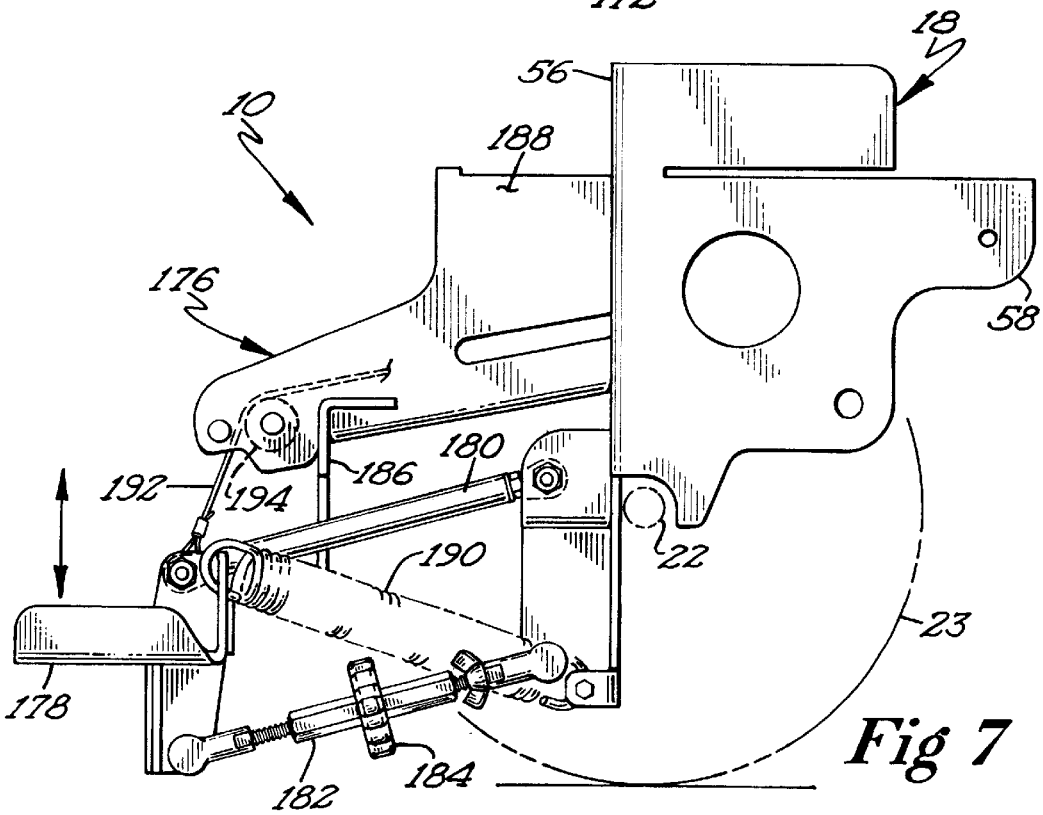
FIG. 7 is partial, side view showing the provisions for floating the squeegee assembly on the floor surface, with portions shown in phantom and being broken away.
Figure 8:
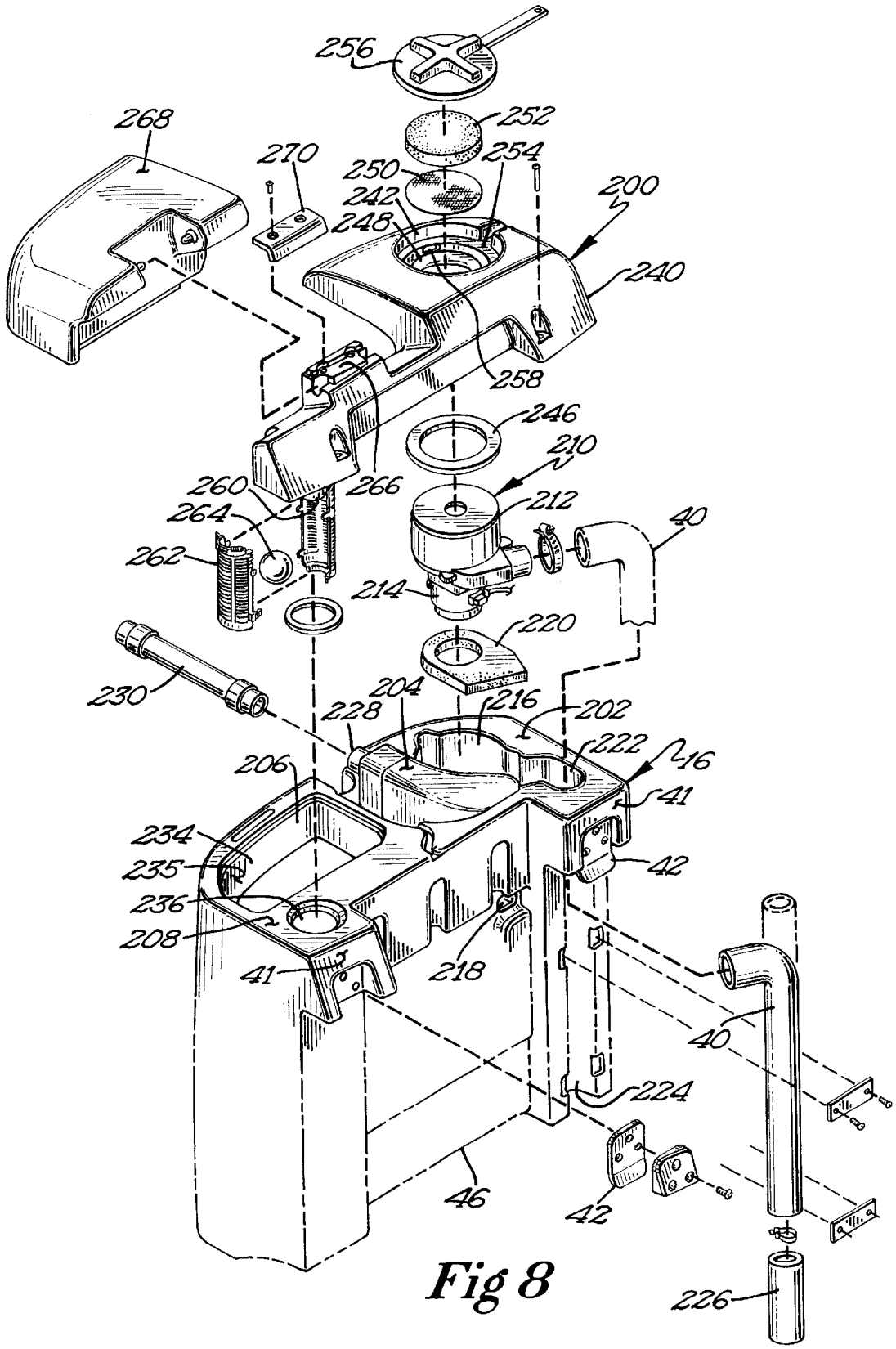
FIG. 8 is an exploded perspective view showing the recovery tank and vacuum assembly, with portions shown in phantom and being broken away.
Figure 9:
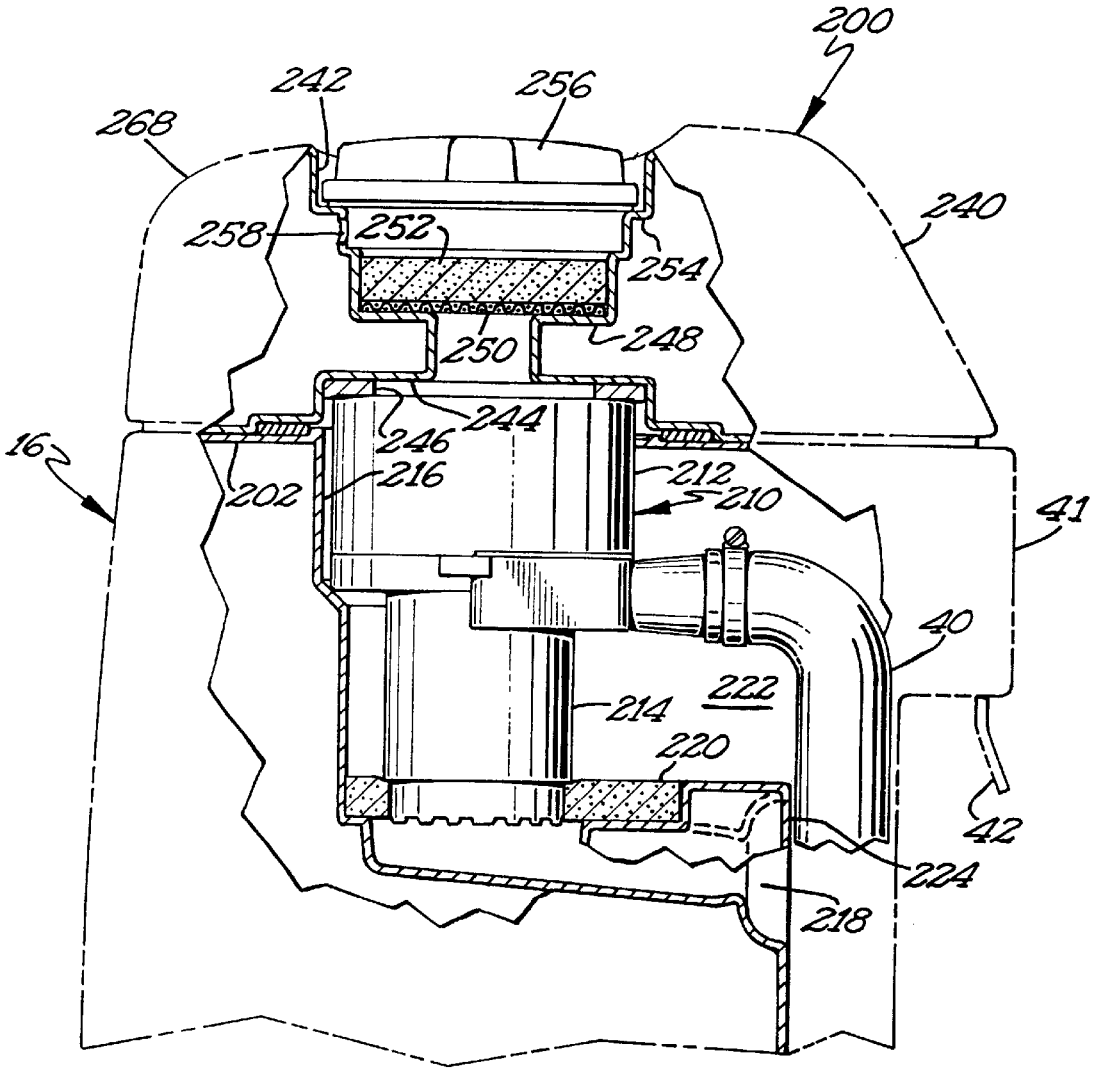
FIG. 9 is a sectional view showing the recovery tank and vacuum assembly, with portions shown in phantom and being broken away.
Figure 10:
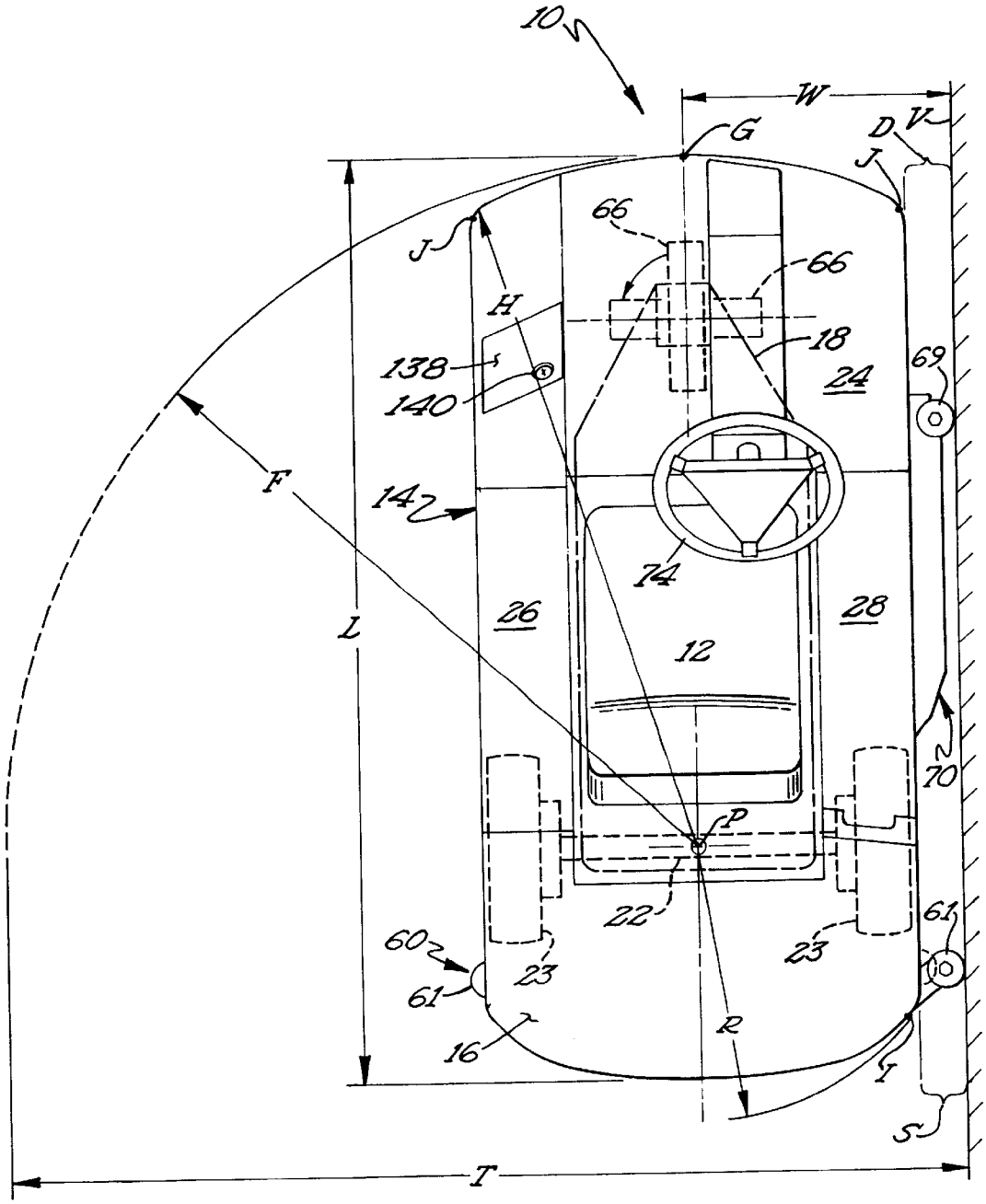
FIG. 10 is a diagrammatic top view thereof.

Column 2,
Line 1, cancel "fall" and substitute therefor -- full --.
Line 47, cancel "FIG. 2," and substitute therefor -- FIG. 2; --.

Column 21,
Line 7, cancel "1" and substitute therefor -- 2 --.
Line 34, cancel "3" and substitute therefor -- 1 --.

Column 22,
Line 26, cancel "9" and substitute therefor -- 12 --.

Signed and Sealed this

Fifteenth Day of October, 2002

*Attest:*

*Attesting Officer*

JAMES E. ROGAN
*Director of the United States Patent and Trademark Office*